US006440052B1

(12) United States Patent
Reider et al.

(10) Patent No.: US 6,440,052 B1
(45) Date of Patent: Aug. 27, 2002

(54) SYSTEM FOR DIRECTING A LEADING EDGE OF CONTINUOUS FORM PAPER ONTO A STACK

(75) Inventors: Robert J. Reider, Longmont; Ronald R. Campbell, Boulder, both of CO (US)

(73) Assignee: Pentax Technologies Corporation, Broomfield, CO (US)

( * ) Notice: Subject to any disclaimer, the term of this patent is extended or adjusted under 35 U.S.C. 154(b) by 0 days.

(21) Appl. No.: 09/472,907

(22) Filed: Dec. 27, 1999

Related U.S. Application Data

(62) Division of application No. 08/969,831, filed on Nov. 13, 1997, now Pat. No. 6,071,223.

(51) Int. Cl.[7] ..... B31B 1/00

(52) U.S. Cl. ..... 493/410; 493/11; 493/23; 493/24

(58) Field of Search ..... 493/11, 23, 24, 493/356, 357, 410–414, 409, 417; 270/39.01–39.05

(56) References Cited

U.S. PATENT DOCUMENTS

| | | | |
|---|---|---|---|
| 2,906,527 | A | 9/1959 | Blain |
| 3,187,172 | A | 6/1965 | Lettan |
| 3,460,825 | A | 8/1969 | Mets et al. |
| 3,627,304 | A | 12/1971 | Reeder et al. |
| 3,735,975 | A | 5/1973 | Sukel et al. |

(List continued on next page.)

FOREIGN PATENT DOCUMENTS

| | | |
|---|---|---|
| GB | 1215558 | 12/1970 |
| JP | 53142818 | 4/1977 |
| JP | 52-50818 | 11/1977 |
| JP | 52155534 | 12/1977 |
| JP | 53-709195-8930 | 6/1978 |
| JP | 54110021 | 8/1979 |
| JP | 55-4070 | 1/1980 |
| JP | 55-44421 | 3/1980 |
| JP | 55-66456 | 5/1980 |
| JP | 56-21713 | 5/1981 |
| JP | 56-61271 | 5/1981 |

(List continued on next page.)

OTHER PUBLICATIONS

An English Language abstract of JP 55–66456.
An English Language abstract JP 56–61271.
An English Language abstract of JP 59–7672.
IBM Technical Disclosure Bulletin vol. 13, No. 1, Jun. 1970.
Pentax Active Stacking System Brochure, Dec. 14, 1995.
English Language Translation of JP 3–243564.

*Primary Examiner*—Eugene Kim
(74) *Attorney, Agent, or Firm*—Greenblum & Bernstein, P.L.C.

(57) ABSTRACT

Two movable members, one on either side of a pre-folded continuous form entering a paper stacking area, are driven according to a determined position of the pre-folded form to push a leading edge of the form to one or another side of the stacking area so that the folds in the form will develop correctly in a stack. Only one of the members is permitted to contact the form at any time, and the members are separated by a sufficient angle so that no position of the members permits both members to contact the form. After directing the first and second sheets of the form, the members return to a home position in which neither member obstructs or interferes with subsequent stacking of the form. The position of the pre-folded form may be determined by a leading edge sensor, by a sheet feed rate sensor, by a fold position sensor, by a fold orientation sensor, by timing from a predetermined position, or by manual input. When a fold detector orientation sensor is used, the leading edge is appropriately directed to one or another side of the stacking area depending on the orientation of the folds detected in the form. The fold orientation sensor may use the properties of the stiffness of the continuous form and fold memory to detect the orientation of a fold.

5 Claims, 18 Drawing Sheets

U.S. PATENT DOCUMENTS

| | | | |
|---|---|---|---|
| 4,427,404 | A | 1/1984 | Yamada et al. |
| 4,460,350 | A | 7/1984 | Mittal et al. |
| 4,494,948 | A | 1/1985 | Teyssier, Jr. |
| 4,508,527 | A | 4/1985 | Uno et al. |
| 4,723,488 | A | 2/1988 | Inouye et al. |
| 4,751,879 | A | 6/1988 | Van Pelt |
| 4,811,688 | A | 3/1989 | Turner |
| 5,029,828 | A | 7/1991 | Sato et al. |
| 5,030,192 | A | 7/1991 | Sager |
| 5,074,836 | A | 12/1991 | Fechner et al. |
| 5,123,890 | A | 6/1992 | Green, Jr. |
| 5,149,075 | A | 9/1992 | Crowley et al. |
| 5,242,366 | A | 9/1993 | Kita |
| 5,255,008 | A | 10/1993 | Yoshida |
| 5,425,694 | A | 6/1995 | Negishi |
| 5,529,564 | A | 6/1996 | Hediger |
| 5,616,113 | A * | 4/1997 | Van Den Bergh |

FOREIGN PATENT DOCUMENTS

| | | |
|---|---|---|
| JP | 57-98465 | 6/1982 |
| JP | 58-3807 | 1/1983 |
| JP | 59-7672 | 1/1984 |
| JP | 59-7326 | 3/1984 |
| JP | 60-1759 | 1/1985 |
| JP | 5-8930 | 1/1993 |

* cited by examiner

SYSTEM FOR DIRECTING A LEADING EDGE OF CONTINUOUS FORM PAPER ONTO A STACK

This is of U.S. patent application Ser. No. 08/969,831 now U.S. Pat. No. 6,071,223 filed Nov. 13, 1997, the contents of which are expressly incorporated by reference herein in its entirety.

BACKGROUND OF THE INVENTION

1. Field of the Invention

The present invention relates to a system and mechanism for directing the leading edge of a continuous form onto a stack, and more particularly, to a device for appropriately directing the leading sheet(s) of a continuous form to begin a stack of forms.

2. Description of Background Information

Refolding and stacking of pre-folded continuous form paper is accomplished either by passive (gravity fed) stackers or by active stacking systems. Passive stackers may use a wire basket (or other box-shaped configuration) in combination with fixed guides. Active stackers use various devices positioned alongside the stacking platform, such as rotating paddles or air jets, to ensure that a stack of continuous form paper stacks correctly. However, laying the first few sheets of a stack is problematic with both passive and active stackers, since both kinds of stackers have no facility for appropriately placing the leading edge depending on the fold orientations encountered such that subsequent folds will develop correctly.

For example, with fan-fold continuous forms of paper or label stock, even after unfolding for printing, folds tend to remain in the continuous form in their original direction or orientation ("fold memory"), alternating between outside folds and inside folds between sheets. In this context, an "outside" fold is one that enters the printer with the fold cusp pointing upward, and an "inside" fold is one that enters the printer with the fold cusp pointing downward. Depending where the last discrete sheet of the form is separated, a leading fold following the leading edge of the form (usually formed at a perforation between sheets) may have either of an outside or inside orientation. Accordingly, a leading fold following the leading edge has a fold cusp pointing up ("outside") or down ("inside").

If the first sheet arriving at the stacking platform arrives such that second sheet folds over in the same direction of the fold memory of the leading fold, subsequent folding of the continuous form will encounter only a small chance of misfolding. However, if the first sheet arriving at the stacking platform arrives such that second sheet folds over against the direction of the fold memory of the leading fold, then all subsequent folds will be folded against the original fold orientation or "fold memory," and misfolding and mis-stacking of the continuous form media will likely occur.

Further, in a laser printer using pre-folded continuous forms, mis-stacking and misfolding often occurs when the toner-fusing or fixing rollers "iron" out the existing folds at the perforations between sheets of the continuous form. As a result, the form folds lose a portion of "fold memory," and tend not to refold easily into a stack. With high speed printers, misfolding and mis-stacking is further exacerbated.

Even when a passive or active stacker may reliably stack a continuous form when a group of initial sheets is properly laid down and folded, an operator must manually lay the first sheet. If sheet feeding is automatic, the operator must still ensure that the leading sheet is in the proper orientation for which the stacker is designed, and may be forced to remove the continuous form media, rotate the media input stack, and replace the media in the printer to orient the leading sheet properly.

SUMMARY OF THE INVENTION

Accordingly, it is an object of the invention to provide a leading edge directing system that appropriately directs leading sheets of a pre-folded continuous form so that all subsequent folding onto a stack develops correctly.

It is a further object of the invention to provide a leading edge directing system capable of directing leading sheets of a continuous form for any orientation of the folds in the pre-folded continuous form.

It is a further object of the invention to provide a fold sensor, and leading edge directing system incorporating the fold sensor, capable of detecting fold orientation in pre-folded or fanfold continuous forms.

The above objects are attained by providing a leading edge directing system for directing the leading edge of a pre-folded form to begin a folded stack in which a controller, connected to a position determining system and a motor, moves both of first and second guide members such that only one of the guide members pushes a leading edge of the pre-folded form toward a front or rear side of a stacking platform according to the position of the pre-folded form as defined by a position determining system. The guide members are movably mounted on either side of an entry path above the stacking platform through which the pre-folded form is introduced toward the stacking platform. The position determining system defines a position of the continuous form. The motor is linked to each of the guide members, and moves the guide members so that only one of the guide members may contact the continuous form at any position of the guide members.

The position determining system may include a leading edge sensor that detects a position of the leading edge of the pre-folded form relative to the guide members. In addition to the leading edge sensor, the position determining system may include a timer that measures the time taken for the leading edge of the pre-folded form to travel a predetermined distance relative to the guide members; or a form movement sensor that directly measures a distance traveled by the pre-folded form relative to the guide members; or a position input device for inputting a predetermined position of the pre-folded form relative to the guide members. Further, in addition to the leading edge system, the position determining system may include a fold orientation determining system for defining an orientation of folds in the pre-folded form, which may have a fold orientation input device for inputting a predetermined orientation of a leading fold in the pre-folded form following the leading edge; or a fold orientation sensor that detects an orientation of folds in the pre-folded form following the leading edge; or a fold position determining system for defining positions of folds in the pre-folded form relative to the guide members.

Preferably, the fold orientation sensor includes one or more walls placed along the transport path, the wall or walls forming a corner that changes a direction of the continuous form and forms a detectable clearance between a wall or walls and the continuous form. The clearance depends on predetermined stiffnesses of the continuous form and the folds. An opening is formed through the wall at the corner, and a media detection sensor, responsive to the detectable clearance to sense the folds in the continuous form, senses the continuous form at the opening.

If a fold orientation sensor is provided, it may be associated with a printer placed upstream along a form transport path leading through the entry path, where the leading edge directing system directs the leading edge of a pre-folded form output by the printer to begin a folded stack. The fold orientation sensor may be positioned upstream of the printer or within the printer along the form transport path.

In this manner, the leading edge directing system can conduct combinations of operations in which the position or orientation of the folds or leading edge are detected, set manually by an operator, or determined. The positions may be determined according to a timer from a known position, or according to direct measurement of the advance of the continuous form or the feeding device. The continuous form may also be set in a predetermined position.

The guide members may be linked to the motor by a common member to move in the same direction. In this case, the guide members may be mounted to rotatably supported shafts parallel to and on either side of to the entry path. The shafts may be driven by a common drive gear driven by the motor, and the gear ratio between the driven gears and the common drive gear may be set such that the driven gears rotate by less than a full rotation for each full rotation of the common drive gear. The common driven gear and the controller may be connected to a home position detector for detecting each full rotation of the driven gear.

The guide members may be provided with a collapsible assembly including a pin; a guide wire for pushing the leading edge of the pre-folded form toward the one of the front and rear sides of the stacking platform; and a resilient biasing member that pushes the guide wire against the pin in the same direction as the guide wire pushes the leading edge. In this manner, the guide wire is collapsible, away from the pin, when the guide wire encounters an obstacle along the same direction as the guide wire pushes the leading edge. Preferably, the collapsible assembly is rotatably mounted, and the resilient biasing member includes a torsion spring coaxial with a center of rotation of the collapsible assembly.

Preferably, each of the front and rear guide members includes one or more elongated guide wires rotatable into the entry path to push the leading edge of the pre-folded form toward the one of the front and rear sides of the stacking platform.

The motor is preferably linked to each of the first and second guide members by a transmission mechanism that maintains an angle of 30 to 100 degrees between the members at any position, so that only one of the guide members may contact the continuous form at any position of the guide members. The angle is more preferably 45 to 90 degrees, and ideally approximately 90 degrees. Below 45 degrees, and even more so below 30 degrees, during operation, there is an increased chance that the wire guide on the non-contacting side will contact or interfere with the sheet. Above 90 degrees, and even more so above 100 degrees, the mechanical design becomes cumbersome. At approximately 90 degrees, smooth operation, with each wire guide moved out of the way when not needed, is ensured.

In one modification of the system, according to the form position defined by the position determining system, the controller moves the guide members such that only one of the guide members pushes the leading edge of a first sheet of the form toward a side of the stacking platform, and subsequently moves the guide members such that the remaining guide member pushes the leading edge of the second sheet toward the remaining side of the stacking platform. In another, the controller subsequently returns the guide members to a home position in which neither guide member interferes with subsequent stacking of the continuous form.

In another aspect of the invention, a fold detector detects folds in a pre-folded continuous form moving along a transport path. The fold detector includes one or more walls placed along the transport path, the wall or walls forming a corner that changes a direction of the continuous form and forms a detectable clearance between a wall or walls and the continuous form. The clearance depends on predetermined stiffnesses of the continuous form and the folds. An opening is formed through the wall at the corner, and a media detection sensor, responsive to the detectable clearance to sense the folds in the continuous form, senses the continuous form at the opening.

In one version of this aspect of the invention, two substantially straight walls intersect to form an angled corner that changes a direction of the continuous form, so that when no detectable fold is at the angled corner, the detectable clearance forms between one of the substantially straight walls and the continuous form. When a detectable fold is at the angled corner, the detectable clearance reduces, and the media detection sensor is responsive to the reducing of the detectable clearance to sense the folds in the continuous form.

In this case, the media detection sensor may include a limit switch having a movable lever emerging from the opening at the one of the substantially straight walls, so that the movable lever is depressed and the limit switch activated when the detectable clearance is reduced. Conversely, the movable lever is released and the limit switch deactivated when the detectable clearance is formed. Preferably, the two substantially straight walls intersect at a right angle to form a right angle corner, and the wall having the opening is vertical, the remaining wall being horizontal.

In another version of this aspect of the invention, an arcuate wall forms an arcuate corner that changes a direction of the continuous form when a detectable fold is at the arcuate corner, so that the detectable clearance forms between the arcuate corner and the continuous form. When no detectable fold is at the arcuate corner, the detectable clearance is reduced, and the media detection sensor is responsive to the forming of the detectable clearance to sense the folds in the continuous form. Preferably, the arcuate wall curves from a horizontal direction to a vertical direction.

The media detection sensor may include a proximity switch directed through the opening, so that when the detectable clearance is formed, the proximity switch is deactivated, and when the detectable clearance is reduced, the proximity switch is activated.

In still another aspect of the invention, a leading edge directing system directs the leading edge of a pre-folded form (having folds formed therein) moving along a transport path to begin a folded stack. A controller, connected to a media detection sensor and a motor, moves guide members such that, depending on the positions of folds detected by the media detection sensor, the guide members push a leading edge of the pre-folded form toward one of front and rear sides of the stacking platform. The pre-folded form is introduced toward the stacking platform through an entry path above the stacking platform. The guide members are movably mounted along the entry path on either side of the stacking platform and above the stacking platform, and the motor is linked to and moves the guide members. A fold detection corner that changes a direction of the continuous form is located at a predetermined position, upstream of the entry path and along the transport path. The fold detection corner forms a detectable clearance between itself and the continuous form, and the media detection sensor is responsive to the detectable clearance to detect the positions of the folds in the continuous form.

BRIEF DESCRIPTION OF THE DRAWINGS

The present invention is further explained in the description that follows with reference to the drawings, illustrating, by way of non-limiting examples, various embodiments of the invention, with like reference numerals representing similar parts throughout the several views, and in which.

DESCRIPTION OF THE PREFERRED EMBODIMENTS

Figure 1:
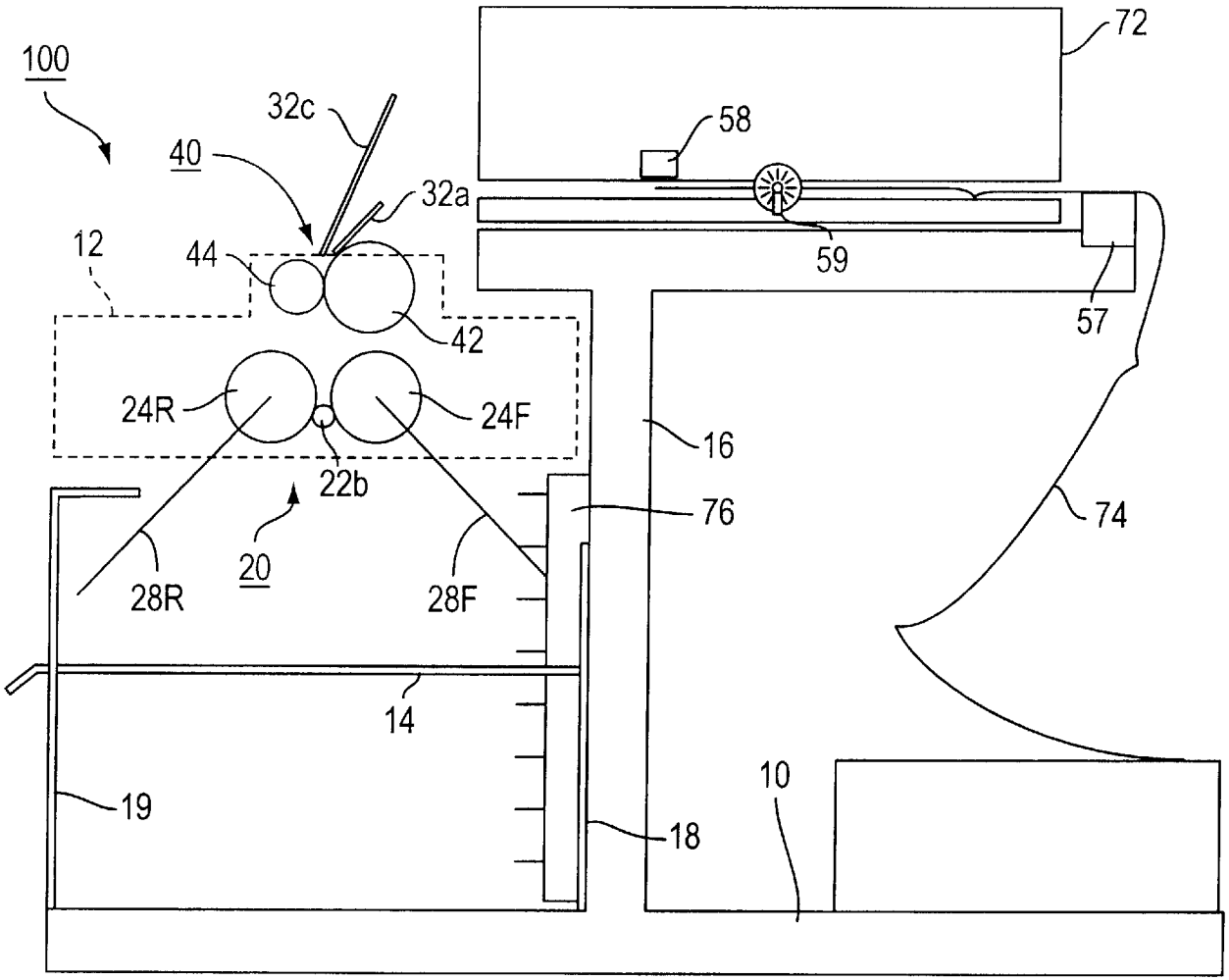
FIG. 1 is a schematic side view of a first embodiment of the leading edge directing system according to the present invention.

FIG. 1 is a schematic view of the leading edge directing system according to the invention, the system operating with a continuous form printer 72.

Referring to FIG. 1, the printer 72 and leading edge directing system 100 are directly supported on a base 10. Alternatively, the printer 72 may be supported by its own support structure. The base 10 includes a vertical support 16, which supports the continuous form printer 72.

The continuous form printer 72 is preferably a conventional electrophotographic continuous form printer, including a sheet feeding device and a printing device, the printer 72 accepting and printing upon pre-folded continuous form paper (fan fold paper, label stock, and the like). As shown in FIG. 1, the continuous form printer 72 discharges the continuous form paper into the leading edge directing system 100. Once the leading edge of the initial sheet(s) of the pre-folded continuous form has been appropriately directed by the leading edge directing system as described below, subsequent stacking may be performed with the assistance of an active stacking mechanism 76.

The leading edge directing system 100 includes a leading edge directing mechanism incorporating a rotatable guide assembly 20, which directs the leading edge of a pre-folded continuous form in an appropriate direction for correct stacking. As shown in FIGS. 1–4, the rotatable guide assembly 20 preferably includes a front guide wire 28F (driven by a front driven gear 24F) and a rear wire gear 28R (driven by a rear driven gear 24R) as first and second guide members for pushing a leading edge of the pre-folded form toward the front and rear sides of the stacking area. Each of the driven gears 24R, 24F engages and is driven by a common drive gear 22*b*, which is in turn driven by a reversible motor 22.

Figure 2:
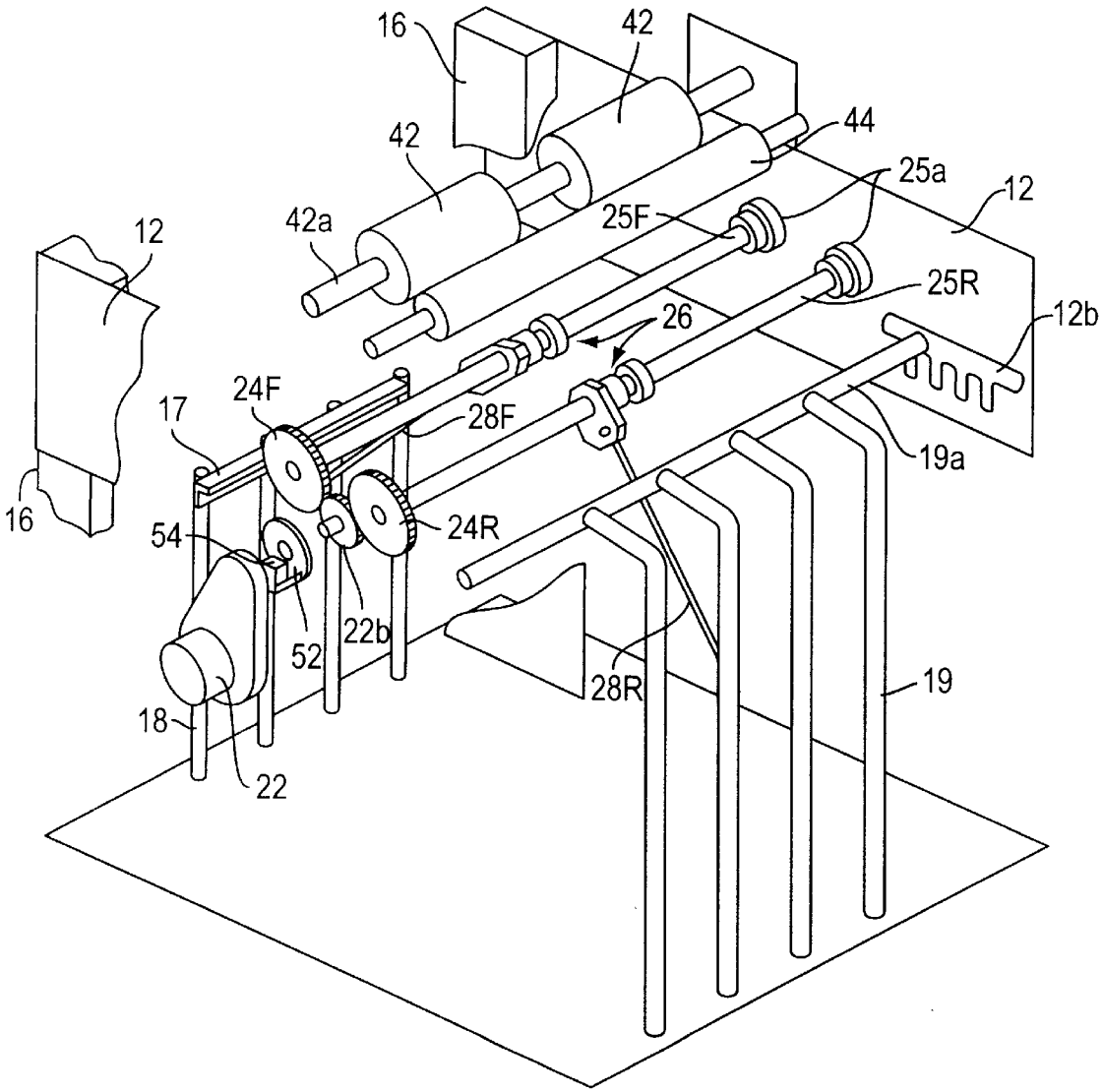
FIG. 2 is a perspective view of a leading edge directing mechanism of the leading edge directing system shown in FIG. 1.
Figure 3:
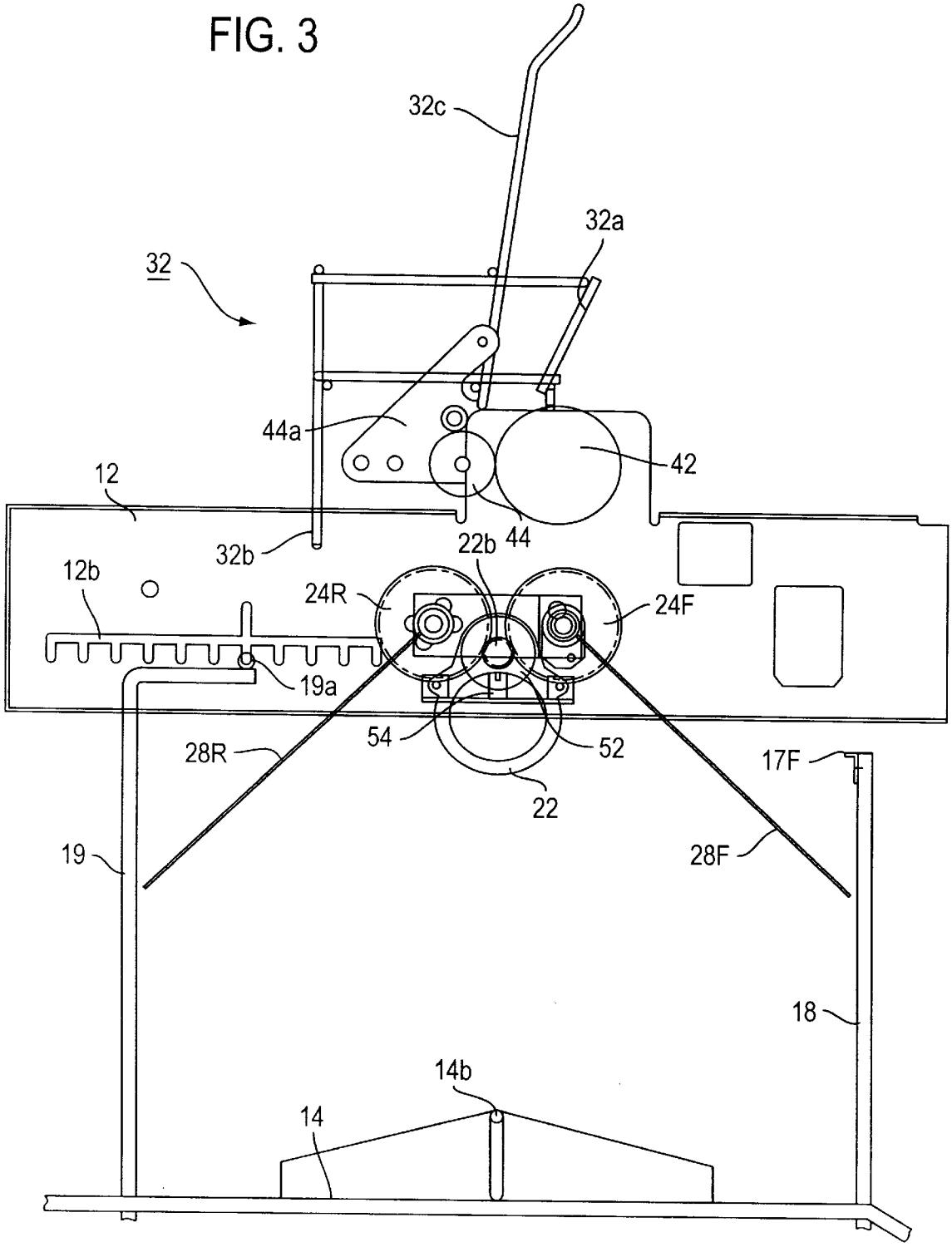
FIG. 3 is a side view of the leading edge directing mechanism shown in FIG. 2.
Figure 4:
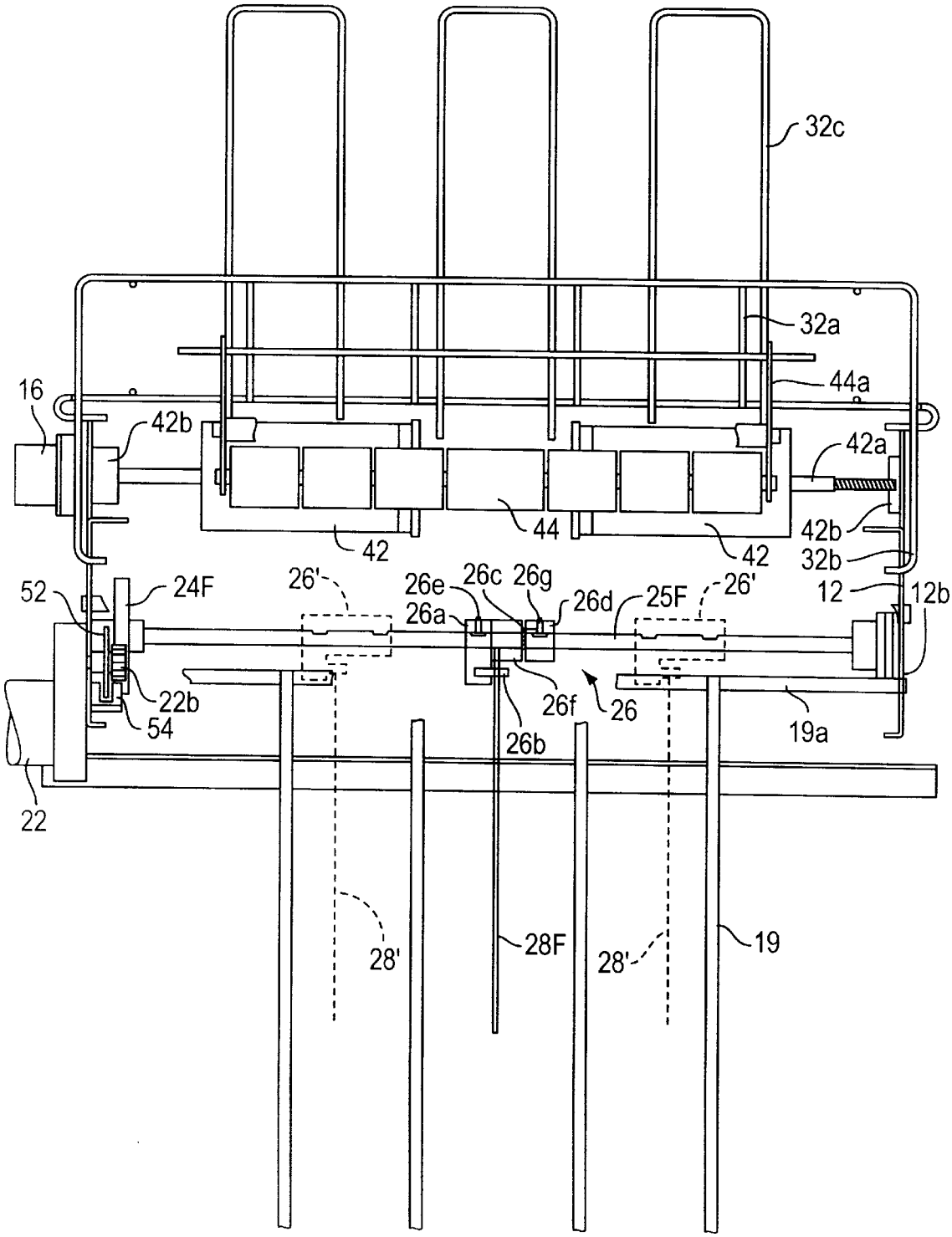
FIG. 4 is a front view of the leading edge directing mechanism shown in FIGS. 2 and 3.

FIG. 2 is a perspective view of an embodiment of the leading edge directing mechanism shown in FIG. 1. As shown in FIGS. 2 through 4, the rotatable guide assembly 20 is supported by a housing 12, which is in turn supported by the vertical support 16. The front driven gear 24F is coaxially fixed to a front (first) driven shaft 25F that is in turn supported by bearing supports 25*a* secured to the housing 12 at either end. Similarly, the rear driven gear 24R is coaxially fixed to a rear (second) driven shaft 25R, which is supported by bearing supports 25*a* secured to the housing 12 at either end. Each of the guide wires 28F and 28R of the rotatable guide assembly 20 is supported by its respective driven shaft 25F, 25R.

The front and rear driven shafts 25F and 25R are spaced to bracket the continuous form path, forming an entry path to the stacking area (i.e., a horizontal stacking support assembly 14 or stacking platform) therebetween. Accordingly, each of the rotatable guide wires 28F and 28R may operate on one side of the continuous form. Furthermore, with this arrangement, neither of the shafts 25F nor 25R interferes with the form transport path or entry path, and the rotatable guide wires 28F and 28R only interfere with the transport path or entry path when one is swung into the transport path to direct the pre-folded continuous form appropriately.

Each of the driven gears 24F and 24R engages the common drive gear 22*b*, which (as shown in FIGS. 2–4) is driven by the (reversible) guide wire motor 22 via a drive shaft 22*a*. The drive motor 22 is affixed to the housing 12. The drive ratio between the drive gear 22*b* and the driven gears 24F, 24R is arranged such that the driven gears 24F, 24R rotate by less than one full rotation for each rotation of the drive gear 22*b*. One preferable gear ratio is 4:1, so that each driven gear rotates by 90° for each full rotation of the drive gear 22*b*. Transmission of driving force to the rotatable guide wires 28F, 28R may be alternatively accomplished by other mechanical drives, for example, a four-bar linkage, eccentric gears, planetary gears, solenoids, etc.

The front and rear rotatable guide wires 28F and 28R are separated by a sufficient angular separation such that only one may contact the continuous form at a time, given that the continuous form fluctuates in position to the front and rear after being guided into the entry path. The guide wires 28F and 28R are so arranged because if guide members on both sides of a continuous form are permitted to contact the form, timing for controlling the guide members must be exact. Furthermore, no matter how well the timing is executed if guide members on both sides of the form are permitted to contact the form, if forms having different characteristics (i.e., thickness, rigidity, length) are introduced into the system, jams and stacking errors are likely to occur. Since the present device is arranged such that only one guide wire contacts the form at a time, such problems are not present.

In FIGS. 2–4, the angle at which the directions of the front and rear rotatable guide wires 28F and 28R intersect in the home position is arranged so that, upon any rotation of the guide wires 28F and 28R, no position of the front and rear wire guides 28F and 28R allows the continuous form to contact both wire guides 28F and 28R. As shown in FIGS. 2–4, the angle is preferably 30–100°. Below 30°, during operation, there is an increased chance that the wire guide on the non-contacting side (28F or 28R) will contact or interfere with the sheet. Above 100°, the mechanical design becomes cumbersome, as the motor 22 increases in size to move the wire guides 28F, 28R more quickly, the shafts 25F, 25R must be farther apart, and the size of the gears 22*b* or 24F/24R may become impractical. The range is more preferably 45–90°, for the same reasons. The range is ideally approximately 90°, ensuring the most smooth operation and that each wire guide 28F or 28R is moved out of the way when not needed. In this context, "approximately 90°" is defined such that the guide wires 28F, 28R may by separated by more or less than 90 degrees, but only one may contact the form at any time.

An encoder 52 is coaxially affixed to the drive shaft 22*a*, and a position sensor 54 supported by the housing 12 senses at least one position of the encoder 52. The home position sensor 54 may be, e.g., an LED and phototransistor combination, or a photointerruptor or magnetic sensor. Preferably, the position sensor 54 detects at least a home position of the rotatable wire guides, 28F and 28R, i.e., a position at which neither of the rotatable guide wires 28F nor 28R is rotated into the form transport path (as shown in FIGS. 2–4).

Each of the rotatable guide wires 28F, 28R is provided with a collapsible assembly 26. As shown in FIG. 4, the collapsible assembly 26 includes a drive lug 26*a*, a drive pin 26*b*, a torsion spring 26*c* as a resilient biasing member, and a torsion support bushing 26*d*. The drive lug 26*a* is fixed to the rotatable driven shaft 25F via a set screw 26*e*. The drive pin 26*b* protrudes from the drive lug 26*a* beside the front guide wire 28F (a guide member of the collapsible assembly 26) on the opposite side of the front guide wire 28F to transport the paper path. The front guide wire 28F is fixed to a bushing 26*f* that is rotatably mounted with respect to the driven shaft 25F. Further, the torsion support bushing 26*d* is fixed to the driven shaft 25F via a set screw 26*g* to rotate therewith. A torsion spring 26*c* (coaxial with the center of rotation of the collapsible assembly 26) links the bushing 26*f* and the torsion support bushing 26*d*, resiliently biasing the bushing 26*f* (and accompanying front guide wire 28F) in the direction of the drive pin 26*b*.

Accordingly, the torsion spring 26*c* pushes the front wire guide 28F against the drive pin 26*b* in the same direction as the front guide wire 28F pushes the leading edge of the pre-folded continuous form 74. The front guide wire 28F (guide member) is collapsible away from the drive pin 26*b* when the front wire guide 28F encounters an obstacle along the same direction as the front wire guide 28F pushes the leading edge of the pre-folded continuous form. That is, if the rotatable driven shaft 25F is rotated in the direction away from the continuous form 74 along the transport path, and the front guide wire 28F encounters an obstacle (or stopper), the drive lug 26*a* and drive pin 26*b*, as well as the torsion support bushing 26*d*, may continue to rotate. However, here, the front guide wire 28F is stopped by the obstacle or stopper, and is held in position by the torsion spring 26*c*. As shown in FIG. 4 by dashed lines, a plurality of front guide wires 28', and accompanying collapsible assemblies 26', may be provided along the length of the front driven shaft 25F.

The rear rotatable guide wire 28R is provided with a collapsible assembly 26 similarly formed to that of the front guide wire 28F, and the description of the collapsible assembly 26 for the rear guide wire 28R is accordingly omitted. Similarly, the rear driven shaft 25R may be provided with a plurality of rear guide wires 28' and collapsible assemblies 26' along the length of the rear driven shaft 25R.

Each of the guide wires 28F, 28R is formed of a rigid wire having sufficient strength to direct the weight of at least a full sheet of the continuous form 74 in the appropriate direction (for example, 0.02–0.05 inch diameter wire, and preferably 0.031 inch diameter spring steel). Wires are advantageous over thicker members or plates because they are cheaper, have lower rotational inertia allowing rapid movement to the target position, and have low noise in operation. If more than one wire is provided along the length of the shafts 25F, 25R, thinner wires may be used.

Although the rotatable guide assembly 20 may operate together with, for example, fixed guides, the leading edge directing system 100 also preferably includes a paper drive roller mechanism 40. The paper drive roller mechanism 40 includes a drive roller 42 and a pressure roller 44, which form a roller nip through which the continuous form 74 may be driven. Front guide rod 32*a* and rear guide rods 32*c* guide the pre-folded continuous form 74 into the roller nip between the drive roller 42 and pressure roller 44. Each of the drive roller mechanism 40 and rotatable guide assembly 20 are supported by the housing 12, which is in turn supported by the vertical support 16. As shown in FIG. 2, two coaxial drive rollers 42 of the drive roller mechanism 40 are supported by the housing 12, via a drive roller shaft 42*a* and drive roller bushings 42*b*.

As shown in FIG. 4, the drive rollers 42 are driven by a drive roller motor 46 supported on the housing 12. The pressure roller 44 is supported at either end by pressure roller brackets 44*a* (shown in FIGS. 3 and 4). The pressure roller brackets 44*a* are swingable together with a wire guide 32, the wire guide 32 including the front guide rod 32*a* and the rear guide rods 32*c*. The wire guide 32 also includes a peripheral rod 32*b*, which is rotatably mounted in the housing 12. Accordingly, the wire guide 32 is swingable with respect to the housing 12, and may be pivoted to swing the pressure roller 44 toward and away from the drive roller 42.

As shown in FIGS. 2–4, a horizontal stacking support assembly 14 (paper stacking table) is provided below the rotatable guide assembly 20. A center rib 14*b* is provided in the center of the horizontal stacking support assembly 14 to push the center of a stack of forms upward, thereby ensuring that a stack does not become thicker at the front or rear end than in the center. A front stacking guide 18 retains stacked paper at the front of the horizontal stacking supporting assembly 14, and is fixed to the base 10. A stopper 17 is affixed to the front stacking guide 18 to limit the movement of the front guide wire 28F (in cooperation with the collapsible assemblies 26, as previously described). A rear stacking guide 19 is provided to the rear of the horizontal stacking assembly, and is movable in the front and rear directions to hold various sizes of sheet for the continuous form 74. The rear stacking guide 19 is supported by a hanger rod 19*a* in hanger slots 12*b* formed in the housing 12. The slots 12*b* are formed at different positions in the front and rear directions, so that the position of the rear stacking guide 19 may be adjusted by moving the hanger rod 19*a* (extending between the guide hanger slots 12*b* in the housing 12) between the different slots 12*b*.

Figure 5:
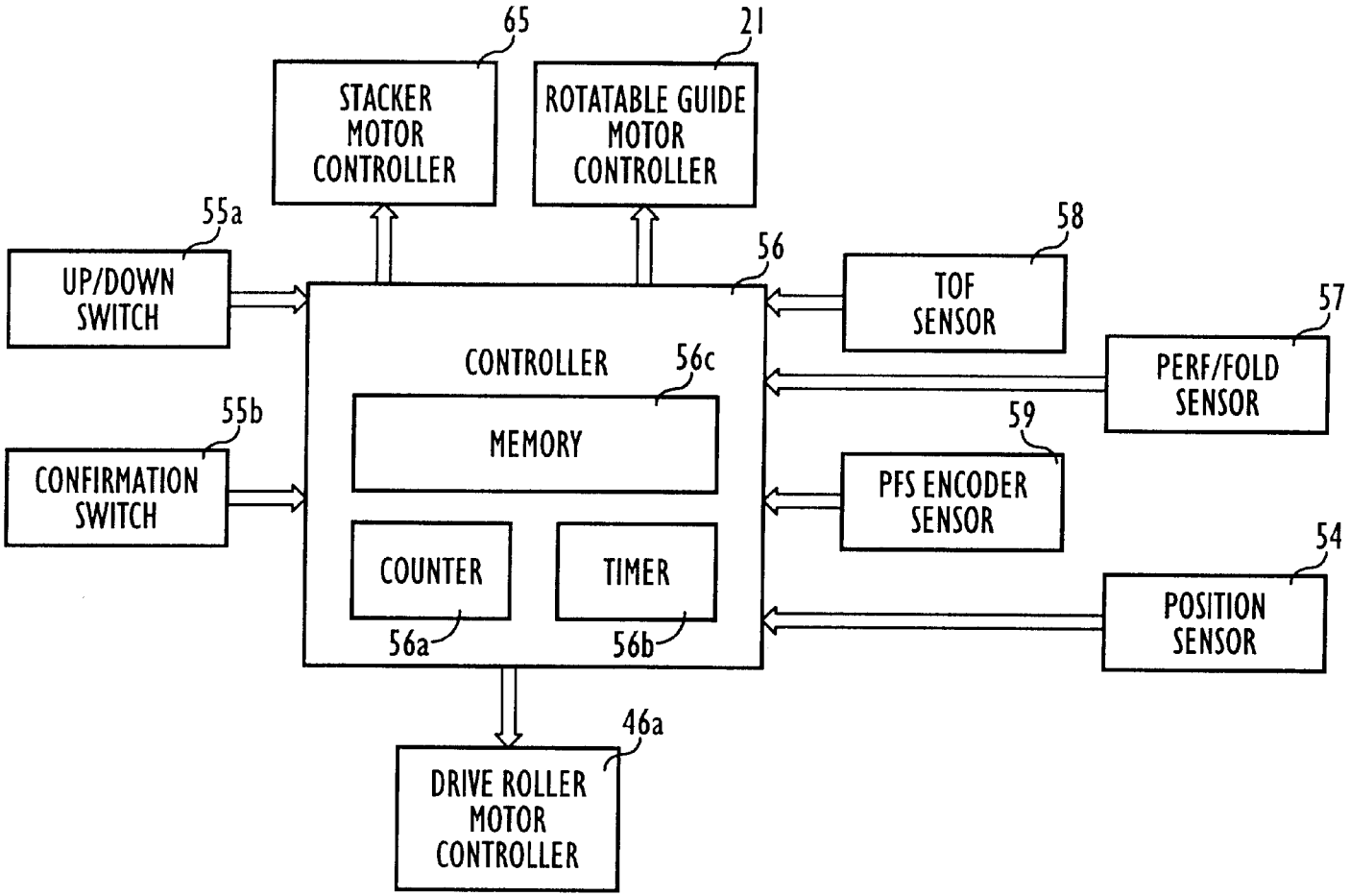
FIG. 5 is a block diagram of a control circuit for controlling the embodiments of the leading edge directing system according to the present invention.

FIG. 5 is a block diagram describing a control system for the leading edge directing system 100. To direct the leading edge of the form properly, the control system must be able to find the position of the form along the feeding path from the printer 72 to the leading edge directing system, relative to the front and rear rotatable guide wires 28F and 28R. Determining the position may be accomplished in several ways. Initially, the position of the leading edge of the form must be set or detected. However, once the position of the leading edge of the form is set or detected, the progress of the form may be measured by a timer used with a known paper feed speed, a form movement sensor that directly measures the progress of the form, or a combination of both. FIG. 5 shows a block diagram in which each candidate determining/sensing device is applied.

As shown in FIG. 5, a controller 56 for controlling the leading edge directing system 100 includes a memory 56*c*, a counter 56*a*, and a timer 56*b*. The counter 56*a* may be used to count paper feed pulses representing a known or measured feeding amount (described later), and the timer 56*b* may be used to time intervals according to a known paper feed speed as the pre-folded continuous form is fed. A top of form (TOF) sensor 58 (preferably provided in the printer 72, but which may be positioned anywhere along the paper feed path) is connected to the controller 56 via an appropriate interface. The top of form (TOF) sensor 58 detects a leading edge of a continuous form as the form passes along the transport path (preferably within the printer 72). In combination with the memory 56*c*, counter 56*a*, and timer 56*b*, and given a known or measured paper feeding speed, the TOF sensor 58 may act as a portion of a position determining system that detects a position of the leading edge of the pre-folded form relative to the feeding path and the front and rear rotatable guide wires 28F and 28R.

Figure 12:
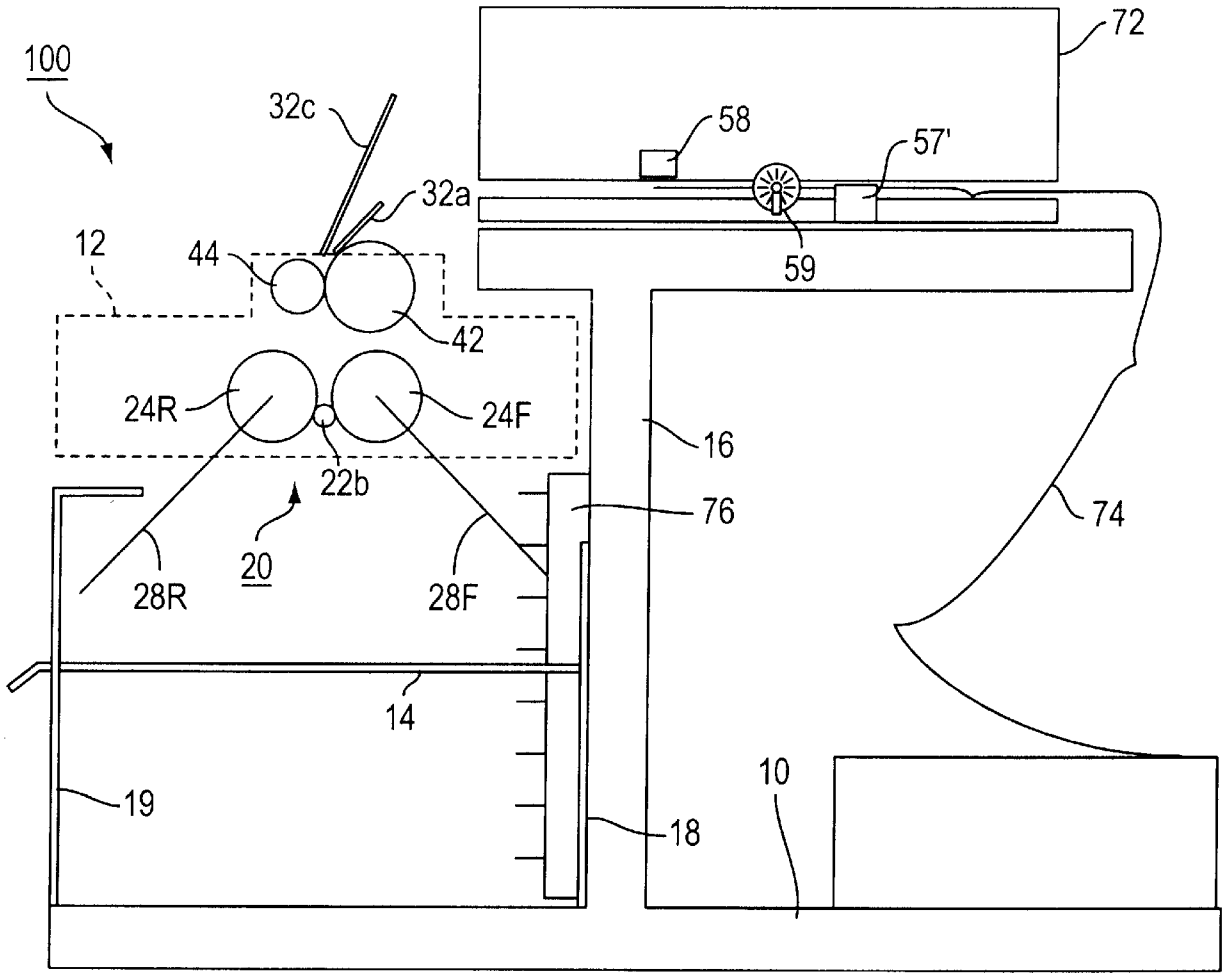
FIG. 12 is a schematic side view of a second embodiment of the leading edge directing system according to the present invention, in which a perforation/fold detector is placed within a printer.

A perforation/fold sensor 57 is also connected to the controller 56 via an appropriate interface. The perforation/fold sensor 57 is preferably situated upstream of the printer, i.e., before the continuous form enters the printer 72. In this manner, the perforation fold sensor 57 may sense the folds of the continuous form before the folds are "ironed out" by the fusing/fixing rollers of the electrophotographic printer 72. However, the perforation/fold sensor 57 may also be placed at any location along the form transport path, even within the printer 72 itself (as shown in FIG. 12). The perforation/fold sensor 57 may be a proximity sensor, a limit switch, a photointerruptor, a reflective sensor, or any other sensor capable of detecting the orientation of a fold (as described with reference to FIGS. 13A–17B). In combination with the counter 56*a*, memory 56*c*, and/or the timer 56*b*, the perforation/fold sensor 57 acts as a portion of a fold orientation determining system that defines an orientation of folds in the pre-folded form, and as a portion of a fold position determining system for defining positions of folds in the pre-folded form relative to the position of the front and rear rotatable guide wires 28F, 28R. Suitable fold sensors (60, 60') suitable for use as the perforation/fold sensor 57 are described below with reference to FIGS. 13A through 17B.

A PFS encoder sensor 59 is connected to a tractor or driving device within the printer 72 and detects forward advance of a continuous form 74. In a preferred embodiment, the PPS encoder sensor 59 counts ⅙" advances and generates a pulse for each ⅙" advance of the continuous form. In combination with the TOF sensor 58, counter 56*a*, timer 56*b*, and/or memory 56*c*, the PFS encoder sensor 59 acts as a form movement sensor that directly measures the distance traveled by the pre-folded form.

In the leading edge directing mechanism 20, a position sensor 54 connected to the controller 56 senses the position of the encoder wheel 52 and drive gear 22*b* via a notch 52*a* (shown in FIGS. 7–9) formed in the encoder wheel 52. Some of the described sensors are also shown in the schematic view of FIG. 1, according to preferred locations.

An up/down switch 55*a* is also connected to the controller 56, as is a confirmation switch 55*b*. The up/down switch 55*a* may be used to enter a leading fold orientation to the controller 56 (for example, in case the folds in the pre-folded form are difficult to detect). Accordingly, the up/down switch 55*a* acts as a fold orientation input device for entering a predetermined orientation in the pre-folded form following the leading edge. The confirmation switch 55*b* may be used to confirm a predetermined position of the pre-folded form 74 or leading fold along the sheet feeding path. Accordingly, the confirmation switch 55*b* acts as a position input device for entering a predetermined position of the pre-folded form 74 or leading fold relative to the position of the front and rear rotatable guide wires 28F and 28R.

A motor controller 21 is connected to the controller 56, and is driven by the controller 56 to drive the reversible motor 22 in forward and reverse directions. A drive roller motor controller 46*a* controls the drive roller motor 46 and is connected to the controller 56 such that the controller 56 may start and stop the drive roller motor 56. A stacker motor controller 65 may also be connected to the controller 56, for controlling the active stacking mechanism 76 (shown in FIG. 1) that, for example, pushes down the front and rear edges of the continuous form as the form stacks in the stacking area (horizontal stacking support assembly 19).

Figure 6:
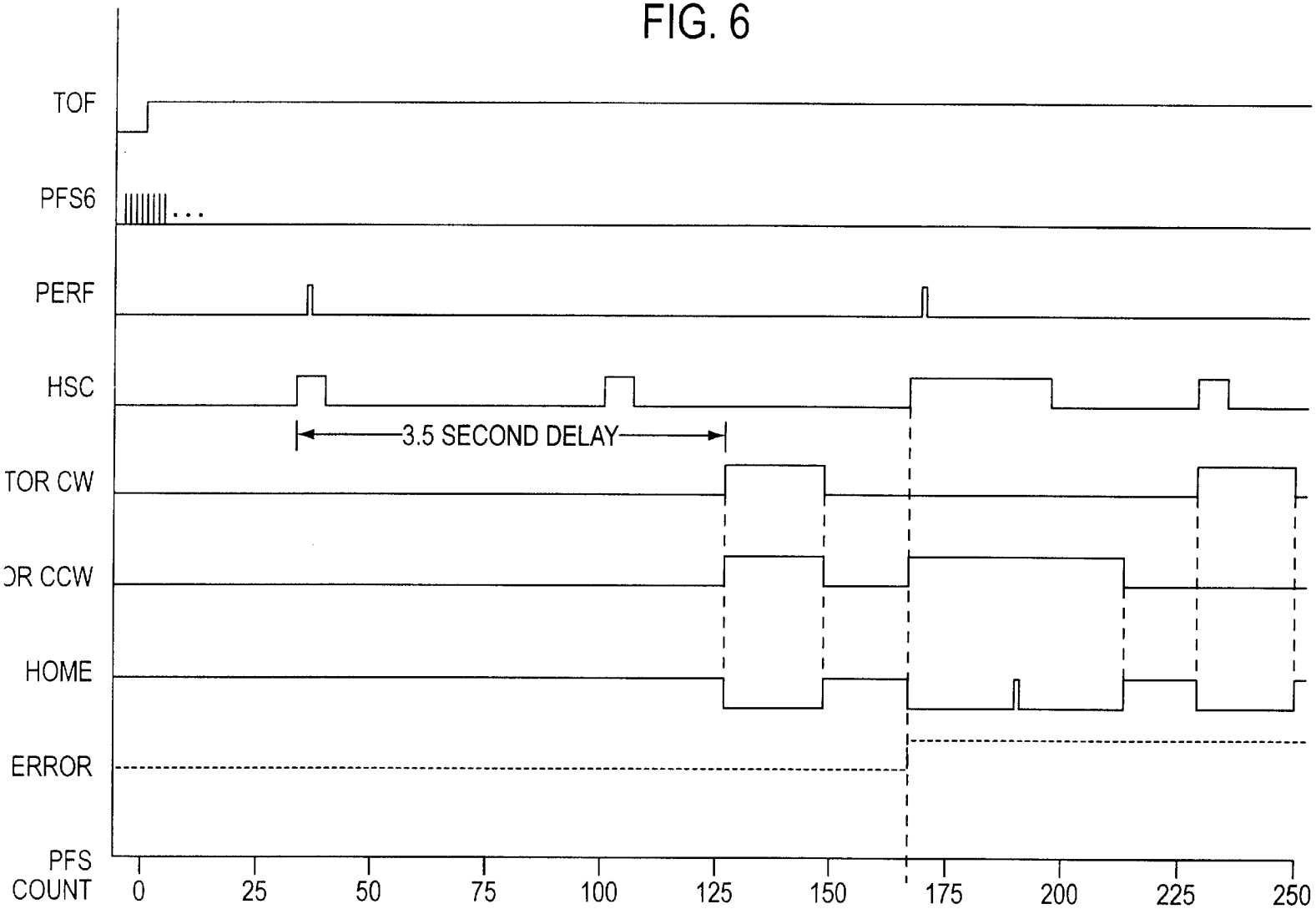
FIG. 6 is a timing chart showing one application of a control timing for controlling the lead edge directing system according to the invention.

FIG. 6 is a control/timing chart representing a control routine carried out to move the front and rear rotatable guide wires 28F and 28R to place the first and second sheets of the continuous form in appropriate positions, and to return the rotatable guide wires 28F and 28R to their home positions when the first two sheets (and leading fold) are so placed. In particular, FIG. 6 represents exemplary timing generated when the first detected fold is an "outside" fold. The timing chart of FIG. 6 and the flow chart of FIGS. 10A and 10B (described later) each represent a control routine in which a combination of a direct position detector (TOF), a direct form advance detector (PFS6), a timer (e.g., timer 56*b*), and a fold detector (PERF) are used to carry out appropriate timing.

Figure 10A:
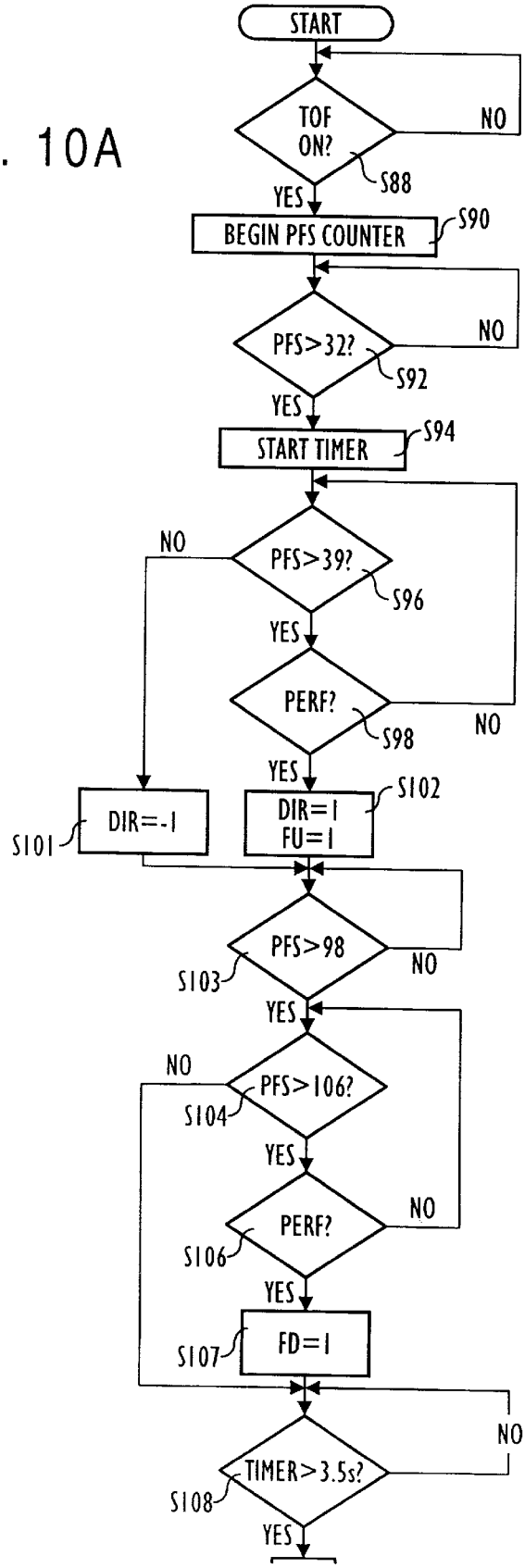
FIGS. 10A and 10B show a flowchart of a routine for controlling the leading edge directing system according to the present invention.
Figure 10B:
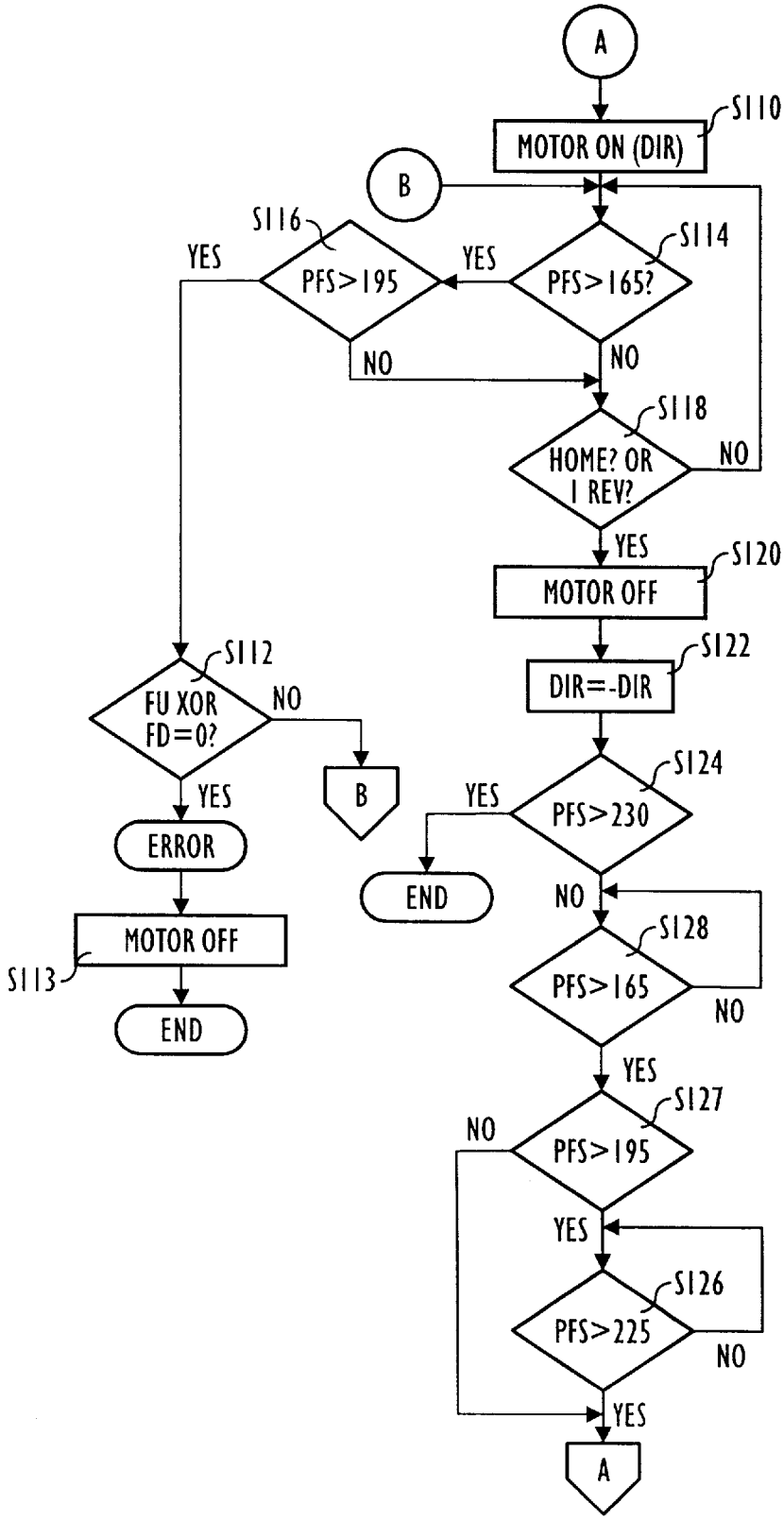

The control routine shown in FIG. 6, and in the flowchart of FIGS. 10A and 10B, is arranged for a sheet length of 11 inches, in which the top of form (TOF) sensor 58 is approximately 15–17 inches (in practice, approximately 15½ inches) downstream of the perforation/fold sensor 57, and in which the leading edge directing mechanism is approximately 17 inches downstream of the top of form (TOF) sensor 58. Accordingly, the tips of the guide wires 28F, 28R are approximately 23–27 inches downstream of the TOF sensor 58. The measurements are taken along the transport path of the continuous form 74, which curves in certain portions, i.e., between the perforation/fold sensor 28 and the printer 72, or between the printer 72 and the leading edge directing mechanism 20.

In this configuration, the leading fold of the sheet following the leading edge is placed between the top of form (TOF) sensor 58 and the perforation/fold sensor 57 before the routines of FIGS. 6, 10A and 10B are carried out. Accordingly, the first detectable fold is actually the second fold following the leading edge of the continuous form. In this context, when discussing the order of folds, a (first, second, etc., "outside" or "inside") "detectable" fold is one that passes the perforation/fold sensor 58 and may be detected by the perforation/fold sensor 58, and a (first, second, etc., "outside" or "inside") fold not identified as "detectable" is in absolute order from the leading edge of the continuous form.

Figure 11:
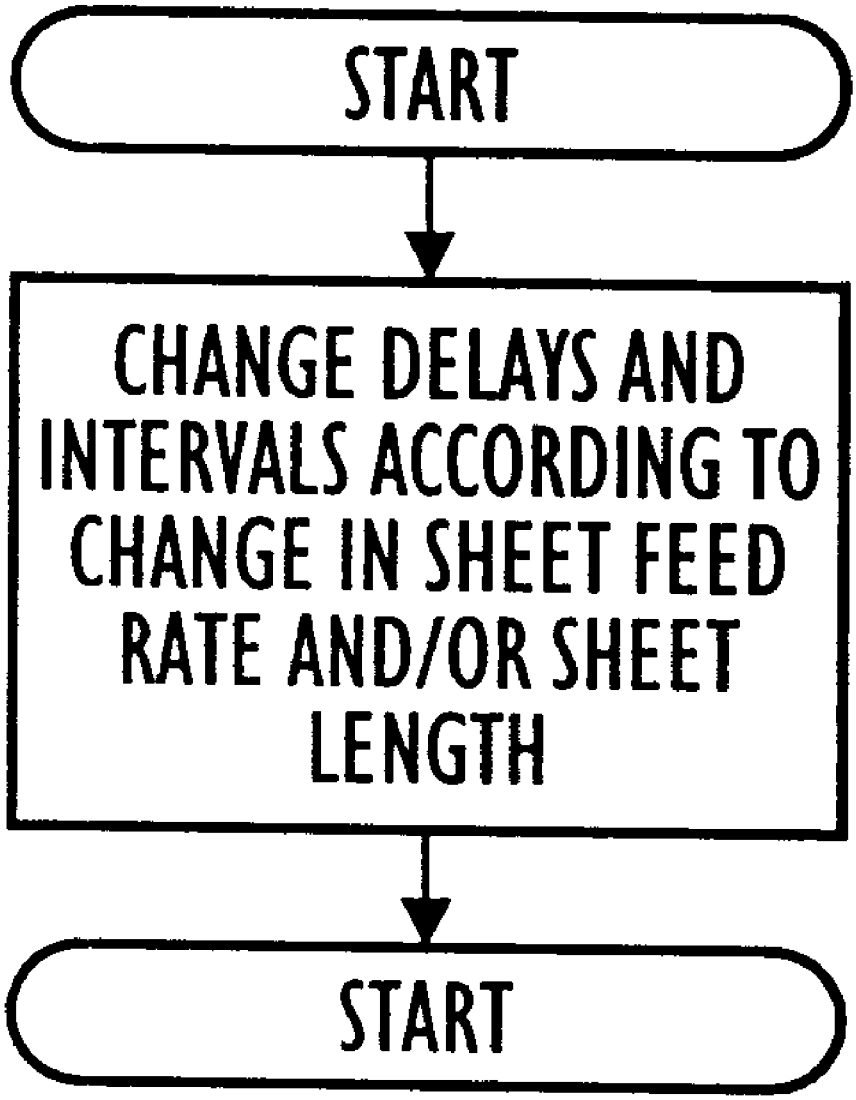
FIG. 11 is a flowchart of a routine in which delays and intervals are adjusted dynamically in response to changing sheet feed rates.

A rate of sheet transport of approximately 4½ inches/second (about 24 sheets of the form per minute) is used. When the continuous form is placed or arrives along the transport path with the leading edge at the TOF sensor 58, the first detectable fold is encountered approximately 5½ inches after the form begins to feed (allowing for variations in the curved feeding path). Accordingly, the first detectable fold (the second fold) is detectable at approximately 33 pulses (6 pulses/inch*5½ inches≈33), the second detectable fold (the third fold) is detectable at approximately at 99 pulses (6 pulses/inch*11 inches+33 pulses≈99), and the rotatable guide motor 22 is first started at approximately 15–16 inches (3½ seconds*4½ inches/second≈15–16) after the top of form (TOF) sensor 58 detects the leading edge of the form 74. However, it should be noted that the pulse counts may be adjusted for a particular length of sheet, and the delays and timing adjusted for a particular feed rate. Moreover, if the feed rate changes for any reason, e.g., if the printer 72 prints a page having a large image or graphic requiring significant processing, the delays and timing may be adjusted to compensate (e.g., by monitoring the PFS sensor 59, as shown in FIG. 11). For example, similar calculations to those above, with appropriate delays and intervals for form size, feed rate, transport path distances, etc., may be performed in the compensating routine shown in FIG. 11.

In FIG. 6, TOF is the top of form signal from the top of form sensor 58; PFS6 is the PFS signal from the paper feed sensor 59; PERF is the perforation/fold signal from the perforation/fold sensor 57; HSC represents critical periods when the PFS counter (for example, counter 56*a*) is monitored by the controller; MOTOR CW represents a clockwise signal sent to the rotatable guide motor controller 21 for driving the drive gear 22*b* in the clockwise direction from the perspective of FIG. 9 (i.e., to move the rotatable guides 28F and 28R from the home position shown in FIG. 7 toward the position shown in FIG. 8A, or to return to the home position shown in FIG. 7 from the position shown in FIG. 9). MOTOR CCW is a similar signal for the counterclockwise direction from the perspective of FIG. 1 (i.e., to move the rotatable guides 28F and 28R from the home position shown in FIG. 7 toward the position shown in FIG. 9, or to return to the home position shown in FIG. 7 from the position shown in FIG. 8A). HOME is a signal from the position sensor 54 upon detection of the home position of the encoder wheel 52, drive gear 22*b*, and front and rear rotatable guides 28F and 28R. ERROR represents an error (if generated at step S112), which may end the process when no folds or two subsequent outside folds "O" are detected.

Figure 7:
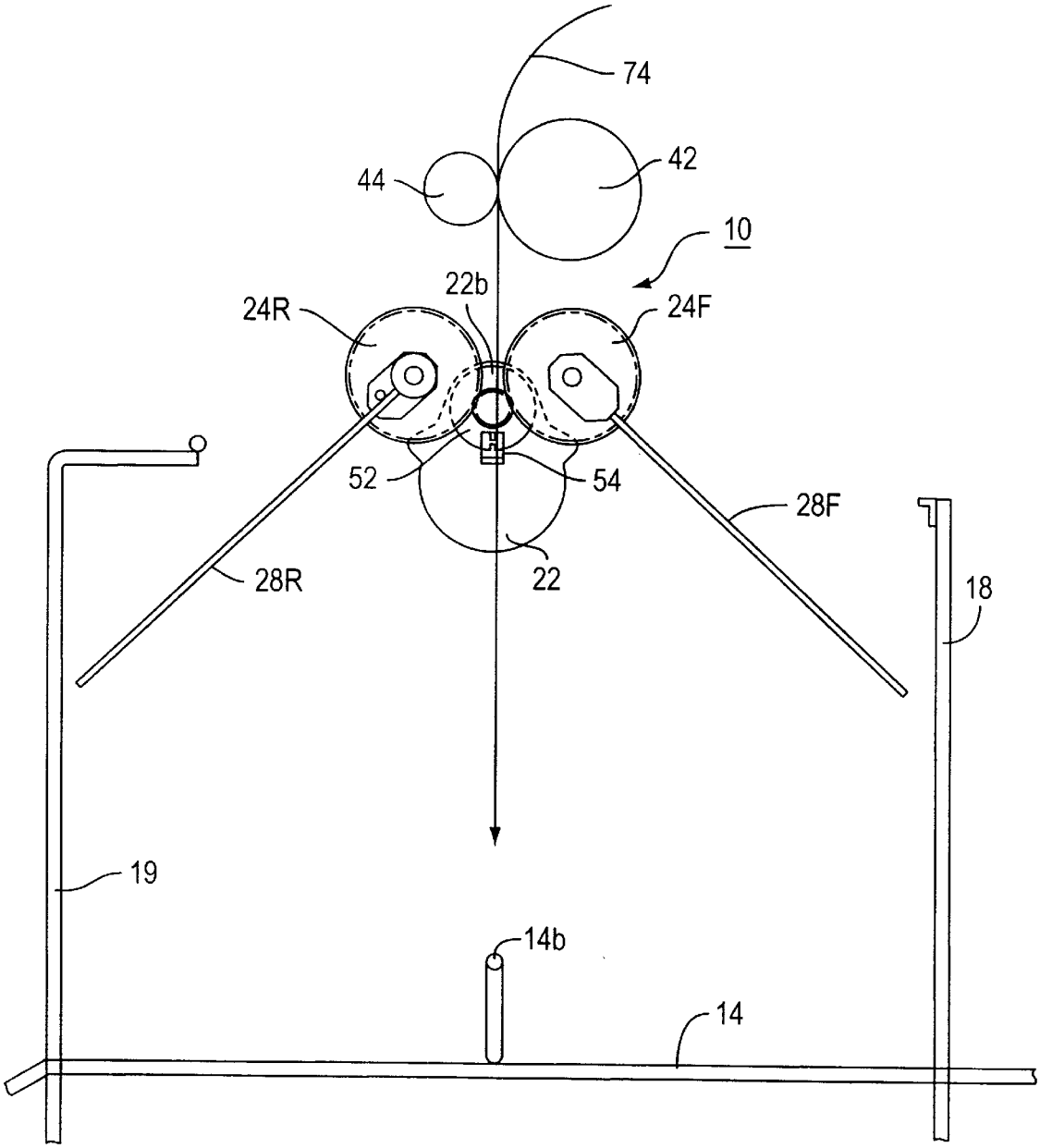
FIG. 7 shows a first position of a continuous form and leading edge directing mechanism according to the invention.
Figure 8A:
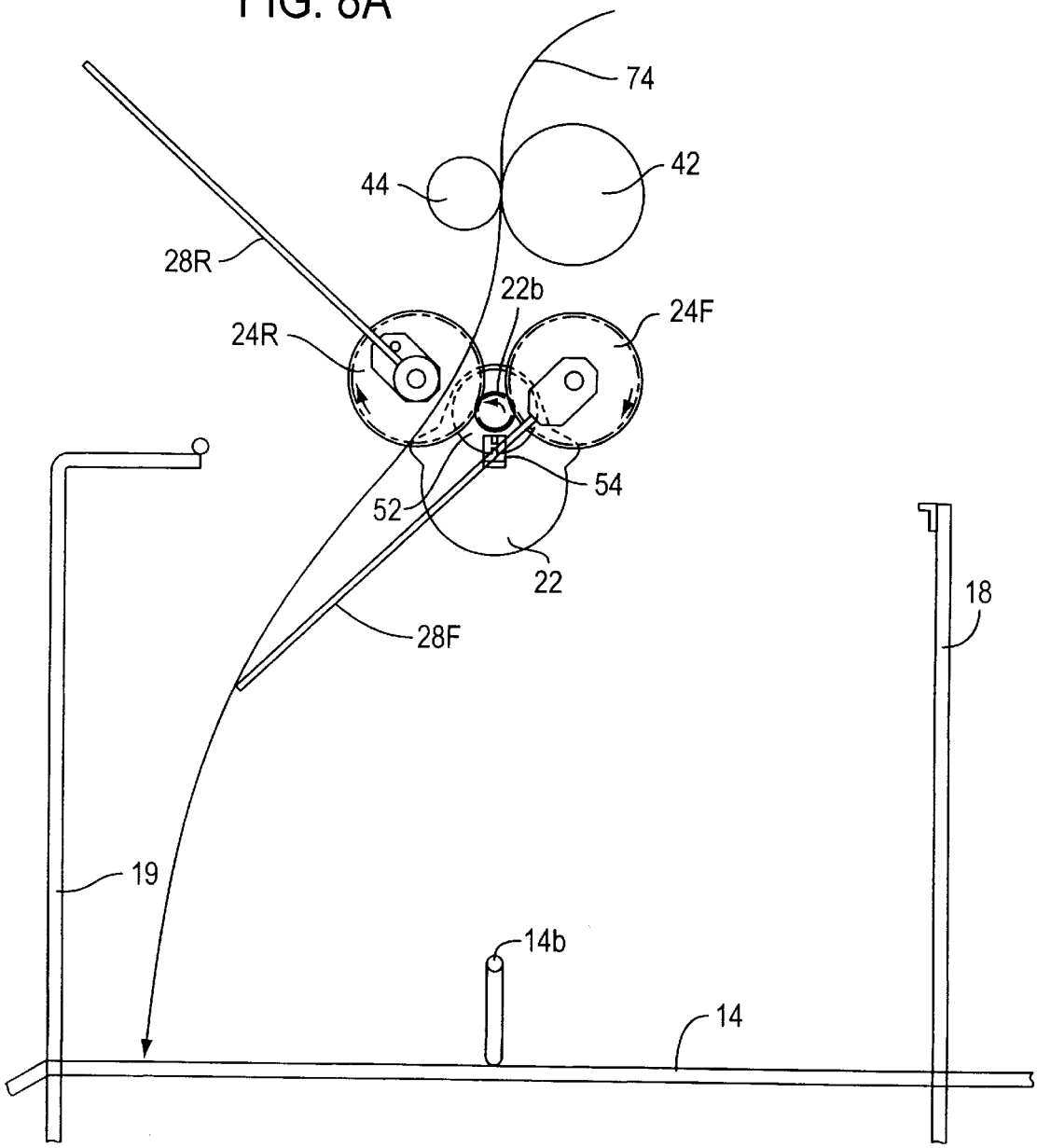
FIG. 8A shows a second position of a continuous form and leading edge directing mechanism according to the invention.
Figure 8B:
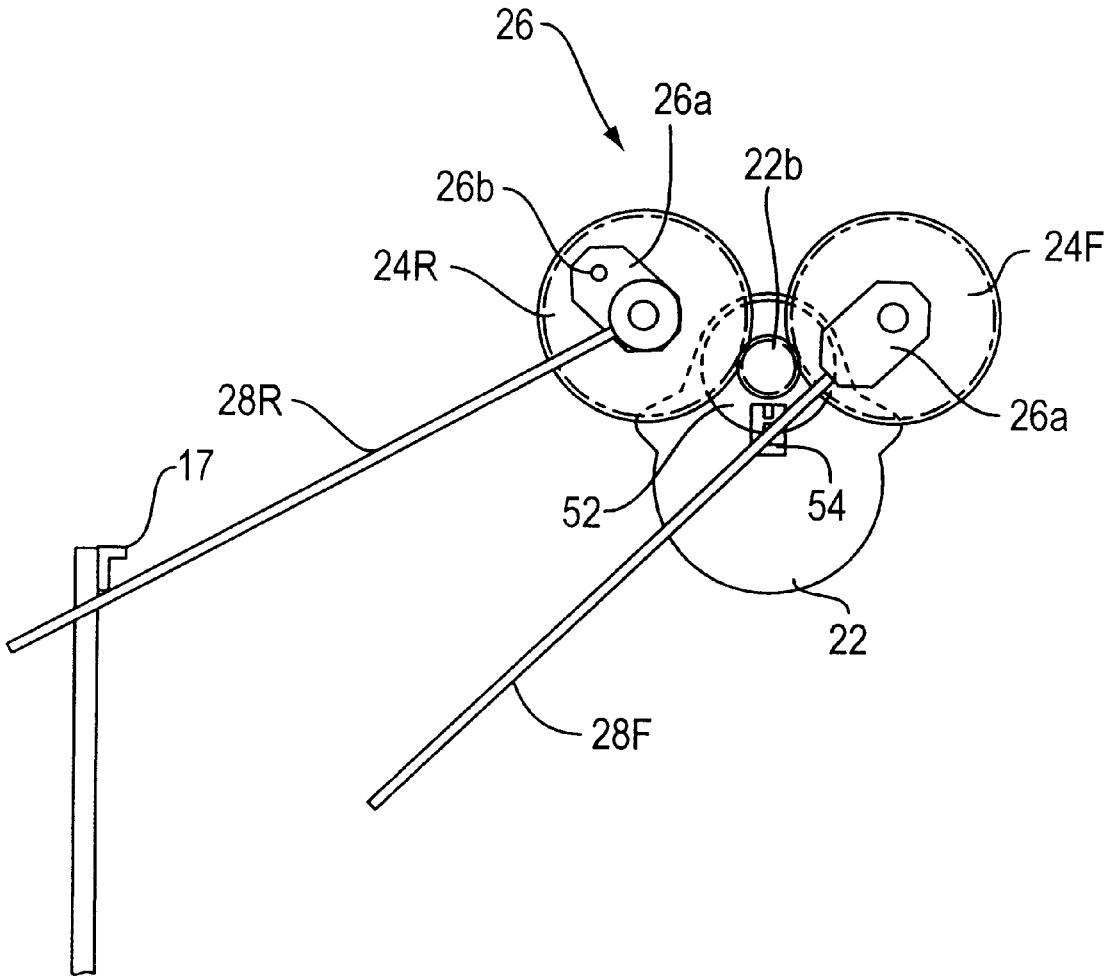
FIG. 8B is a variation of the mechanism shown in FIG. 8A.
Figure 9:
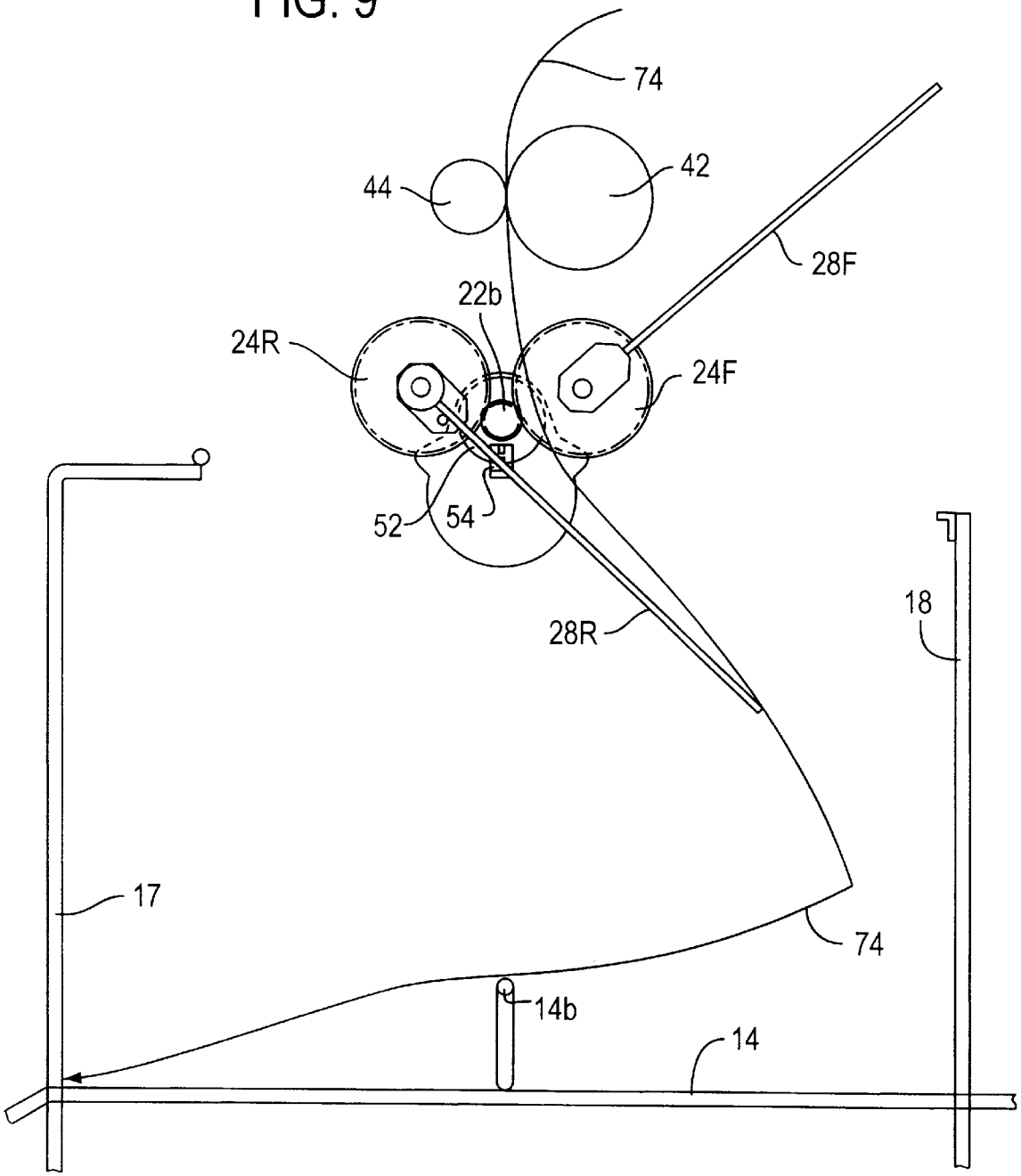
FIG. 9 shows a third position of a continuous form and leading edge directing mechanism according to the invention.

FIGS. 7–9 show various positions of the leading edge directing mechanism 20 according to the invention, which may be generated by the control routine shown in FIGS. 6, 10A, and 10B. In particular, FIGS. 7, 8A, and 9 represent exemplary positions generated when the leading fold is an "inside" fold (i.e., the first detectable fold is an "outside" fold). FIG. 7 shows a home or neutral position where neither of the rotatable guide wires 28F nor 28R is positioned to guide or interfere with the continuous form 74 being fed along the transport path, and each guide 28F and 28R is in a position rotated away from the continuous form 74. FIG. 8A depicts a first variation of the embodiment of a leading edge directing mechanism, in which the front rotatable guide wire 28F directs the leading edge of a continuous form 74 toward the rear of the paper stacking area (horizontal stacking support assembly 14). In FIG. 8A, the rear rotatable guide wire 28R is moved away from the continuous form 74 by the simultaneous rotation of the front and rear driven gears 24F, 24R, as driven by the common drive gear 22*b*.

FIG. 8B shows a second variation of the embodiment shown in FIG. 8A, in which the front guide wire 28F may guide the continuous form 74 toward the rear of the paper stacking area (horizontal stacking support assembly 14). The variation in FIG. 8B is useful when one or more portions of the stacking system obstruct the free movement of the front and rear rotatable guide wires 28F, 28R. In contrast to FIG. 8A, in the variation shown in FIG. 8B, the stopper 17 (also shown in FIGS. 2 through 5) arrests the rotating motion of the rear guide wire 28R. A similar stopper 17 may be positioned to arrest the rotating motion of the front guide wire 28F. As previously described, a collapsible assembly 26 (front or rear) operates such that the drive pin 26*b* and drive lug 26*a* continue to rotate when the motion of the corresponding guide wire 28R (28F) is arrested, as the rear driven gear 24R is rotated simultaneously with the front driven gear 24F. As shown in FIG. 8B, when the motion of the wire guide is arrested, the torsion spring 26*c* keeps the guide wire 28R (28F) biased against the stopper 17, until the drive lug 26*a* and drive pin 26*b* return from the position shown in FIG. 8B when the rear guide wire 28R (28F) is driven back toward the home position shown in FIG. 7.

FIG. 9 shows a position in which the rear guide wire 28R is directed toward the front of the horizontal stacking support assembly 14, directing a second sheet of the continuous form 74, so that the leading fold of the continuous form is appropriately directed to fold toward the front of the stacking area. As shown in FIG. 9, simultaneously, the front guide wire 28F is rotated away from the continuous form 74 by the simultaneous rotation of the driven gear 24F with the driven gear 24R.

As shown in FIG. 6, when the top of form (TOF) signal is detected, the PFS counter (represented by HSC in FIG. 6) begins counting PFS pulse signals (represented by PFS6). At this point, the rotatable guide wires 28F, 28R are in the position shown in FIG. 7. Subsequently, at 33 counted pulses (approximately 5 inches), the timer 56*b* begins counting a 3.5 second delay. Between 33 and 39 PFS pulses, the control routine monitors the perforation/fold signal PERF (in the example of FIG. 6, indicating the first detectable fold being "outside," and leading fold "inside"). Between 99 and 105 the control routine monitors the PFS counter (HSC) to check for a third subsequent fold (in the example of FIG. 6, no detection is recorded since the third fold is "inside").

Following a 3.5 second delay, the motor 22 is started in the counterclockwise direction (to move the rotatable guide wires 28F, 28R toward the position shown in FIG. 8A). The motor 22 is stopped upon the detection of the home signal (HOME), the rotatable guide wires 28F, 28R stopping at the position shown in FIG. 8A (or 8B). At 165 PFS pulses, the motor 22 is started in the clockwise direction (reversed), to move the rotatable guide wires 28F, 28R toward the position shown in FIG. 9. It should be noted that an error is generated between 165 and 195 PFS pulses when no "outside" folds, or when two "outside" folds are detected (in the example of FIG. 6, no error is generated). Between 165 and 195 PFS pulses, action to stop the motor 22 on a detection of the home signal (HOME) is suppressed, i.e., ignored by the controller 56. After 195 PFS pulses, action to stop the motor 22 upon the home signal (HOME) detection is reactivated. When the home signal is detected for the first time after 195 PFS pulses, the rotation of the motor 22 is stopped, stopping the rotatable guide wires 28F, 28R at the position shown in FIG. 9.

At 226 PFS pulses, the motor 22 is started in the counterclockwise direction, to move the rotatable guide wires 28F, 28R to return to the home position shown in FIG. 7. After 230 PFS pulses the control routine ends the process, stopping the rotatable guide wires 28F, 28R at the home position shown in FIG. 7 upon a detection of the home position signal (HOME).

FIGS. 10A and 10B show a flowchart describing a control routine by which the leading edge directing system may be controlled, substantially corresponding to the timing chart shown in FIG. 6, but including steps to handle both "outside" and "inside" leading and/or detectable folds. The control routine shown in FIGS. 10A and 10B starts once printing has begun, and once the leading edge directing system has been activated. As described, timing for detection locations/intervals for controlling the laying of the first and/or subsequent sheet(s) may be arranged according to relaxed ranges (rather than exact values) and the system may therefore handle various types of forms having various characteristics.

As shown in FIGS. 10A and 10B, once printing has begun, control loops at step S88 until the top of form sensor (TOF) detects the leading edge of a pre-folded continuous form along the paper path. Once the top of form sensor 58 (TOF) detects the presence of a continuous form (i.e., the leading edge of a continuous form) in the paper path, the PFS counter (corresponding to HSC in FIG. 6 and/or counter 56*a*) is begun at step S90. As previously described, in this embodiment, the PFS counter counts ⅙" pulses, i.e., ⅙ inch advances of the (e.g., 11 inch sheet) continuous form according to the PFS sensor 59, e.g., an encoder wheel arranged to output a pulse for each ⅙ advance of the feeding device (tractor or rollers, not shown) of the printer 72.

Subsequently, in step S92 the PFS counter is monitored until a count of 33 is reached. In the present embodiment, for the parameters described above (here, for an 11 inch sheet), the first detectable fold ("outside" or "inside") may be expected following the leading edge in the range between 33 and 39 PFS pulses, i.e, a PFS count of 33 indicates that a first detectable fold (perforation) following the leading edge has reached the region in which the perforation or fold may be detected. Accordingly, when the PFS pulse is greater than 32, the timer 56*b* in the controller 56 is started. Subsequently, at step S96, the controller 56 checks if the PFS pulse count is still less than 39. If the PFS pulse is less than 39 in step S96, control continues to step S98, in which the control routine checks if a perforation has been detected. It should be noted that in this embodiment, the fold detector 57 detects only one direction of fold cusp, e.g., an "outside" fold. If an "outside" fold is detected at step S98, signifying that an "outside" fold has been detected in the range between 33 and 39 PFS pulses, then a direction variable (DIR) is set to 1 in step S102, indicating that the first direction of rotation of the rotatable guide motor 46 should place the leading edge to the rear of the horizontal stacking support assembly 14 and the leading fold to the front, i.e., indicating that the front guide wire 28F is to be rotated in a clockwise direction from the perspective of FIG. 1. The control routine further sets a flag "FU" to equal one, indicating that the first detected fold is "outside" (or "up") at step S102. Control then loops at step S103 until the PFS pulse counter (HSC) exceeds 98, indicating that the second detectable fold (the third fold following the leading edge) has entered the region where it may be detected. Subsequently, control continues to step S104.

If the fold is not detected (as "outside") between 33 and 39 PFS pulses, the control routine loops between steps S96 and S98 until the PFS pulse counter (HSC) exceeds 39. When the PFS pulse counter exceeds 39, control continues to step S101, in which the direction variable (DIR) is set to −1, indicating that the leading edge of the continuous form should be placed at the front of the horizontal stacking support assembly 14. In this context, when a perforation/fold detector 57 only detects one direction of fold (e.g., outside "O"), the first "detectable" fold may be an "inside" fold, not directly detected, but detected by the absence of an "outside" fold at the expected position. Control then loops at step S103 until the PFS pulse counter (HSC) exceeds 98, indicating that the second detectable fold (the third fold following the leading edge) has entered the region where it may be detected. Subsequently, control proceeds to step S104.

Steps S104–S107 monitor whether or not a fold is detected between the third and fourth sheets (the second detectable fold), i.e., before the PFS counter reaches 105. In the present embodiment, while the PFS counter (HSC) is in the range between 99 and 105, two 11 inch sheets have passed the fold detector 57, and the second detectable fold after the leading edge of the continuous form (third fold following the leading edge) has reached the region in which a fold may be detected. As described above, before the PFS counter (HSC) reaches 105, the control routine has looped until the PFS counter (HSC) reaches 99 (at step S103). Subsequently, the control routine loops between steps S104 and S106 until the PFS counter (HSC) exceeds 106 or a fold is detected. The controller 56 checks if a fold has been detected (an "outside" fold) at step S106. If a fold is detected, the control routine proceeds to step S107 where a fold down (FD) flag is set to 1, indicating that the first detectable fold following the leading edge of the continuous form is an "inside" fold (necessarily so since the second detectable fold is an "outside" fold). Otherwise, the control routine loops until the PFS counter (HSC) exceeds 106, in which case control proceeds to step S108.

At step S108, the timer 56*b* is monitored to check if it exceeds 3.5 seconds. A delay of 3.5 seconds is set from when the timer starts at a PFS count of 33, representing the time taken for a continuous form 74 to pass from the detection positions of the top of form sensor 58 and the fold sensor 57 to a predetermined position, i.e., representing the position of the pre-folded continuous form at which the leading edge directing mechanism should be initiated. In the present embodiment, this position is reached when the leading edge of the continuous form is within the entry path between the front and rear wire guides 28F, 28R, and timed approximately such that the wire guides 28F,28R are moved into position just as the continuous form reaches the end of the wire guides 28F, 28R. However, it should be noted that the delay may be shortened or lengthened based on, for example, the length or stiffness of a form. Furthermore, the delay may be shortened such that the appropriate one of the front and rear guide wires 28F, 28R is swung into position before the continuous form 74 actually enters the region of the transport path passing between the rotatable guide wires 28F, 28R.

When the timer exceeds 3.5 seconds, control proceeds to step S110. At step S110, the motor is turned ON in the direction previously set in the direction variable DIR (1 or −1). That is, in step S110, if the variable DIR was set to 1 at step S102, the rotatable guide motor 22 is started by the controller 56 in the appropriate direction (counterclockwise from the perspective of FIG. 1) to place the leading edge of the form at the rear of the horizontal stacking support assembly 14. In other words, the rotatable guide motor 22 is started to move the front and rear rotatable guide wires 28F, 28R towards the position shown in FIG. 8A, in which the rotatable guide wires 28F, 28R are rotated from the home position by approximately 90° toward the rear of the horizontal stacking support assembly 14. That is, the drive motor 22 is rotated for one full revolution (in the counterclockwise direction from the perspective of FIG. 1) until the home position is detected.

Conversely, at step S110, if the variable DIR was set to −1 in step S101, then the rotatable guide motor 22 is started by the controller 56 in the appropriate direction (clockwise from the perspective of FIG. 1) to place the leading edge of the continuous form at the front of the horizontal stacking support assembly 14. That is, the motor 22 is started to rotate the front and rear rotatable guide wires 28F, 28R by approximately 90° toward the front of the horizontal stacking support assembly 14. In other words, the motor 22 is started to rotate the front and rear rotatable guide wires 28F, 28R toward positions left-right mirrored with respect to the positions shown in FIG. 8A.

Accordingly, when the first detectable fold following the leading edge of the continuous form is an "outside" fold (i.e., with the fold cusp pointing upward), the leading fold is therefore an "inside" fold, the leading edge of the pre-folded continuous form is placed toward the rear of the horizontal stacking support assembly 14, and the top surface of the continuous form is laid down at the front of the horizontal stacking support assembly 14. In this manner, the leading fold may be folded over at the front of the horizontal stacking support assembly 14. Conversely, when the first detectable fold following the leading edge of the continuous form is an "inside" fold (i.e., with the fold cusp pointing down, as indicated by, e.g., a detection of the second detectable fold as "outside") the leading edge is placed toward the front of the horizontal stacking support assembly 14, and the bottom surface of the continuous form is laid down toward the rear of the horizontal stacking support assembly 14. In this manner, the leading fold may fold over at the rear of the horizontal stacking support assembly 14.

Subsequently, control passes to step S114, at which the PFS counter (HSC) is checked again. Steps S114, S116, S112, and S113 form a routine for error checking and for suppressing the result of the position sensor 54 during a second (reversing) rotation of the motor 22 in the opposite direction to the first rotation. In this respect, during the first rotation after step S108, the PFS counter is less than 165 and the control routine passes without branching through step S114 to step S118. Accordingly, steps S112–S116 are described in detail below in association with the second, reversing rotation.

When control passes to step S118 on the first rotation, the controller 56 checks if the drive gear 22*b* has passed through one full revolution by detection of the home position via the position sensor 54, and returns to step S114 if the home position is not detected. When the drive gear 22*b* has completed one full revolution (when the position sensor 54 detects the home position on the encoder wheel 52), each of the driven gears 24F and 24R and corresponding rotatable guide wires 28F and 28R have turned through one-quarter revolution, or approximately 90°. Accordingly, the control routine loops between steps S114 and S118 until the sensor 54 detects the home position of the encoder wheel 52. When the home position has been detected, control proceeds to step S120, in which the rotatable guide drive motor 22 is turned OFF.

Subsequently, control passes to step S122, in which the direction variable DIR is reversed. That is, the direction variable DIR is made −1 if previously 1, and is made 1 if previously −1. Accordingly, the next time the motor 22 is started in step S110 according to the direction variable DIR and following an execution of step S122, the rotation direction is reversed from the previous rotation.

Control then passes to step S124, at which the controller checks if the routine has ended by detecting if the PFS counter (HSC) has reached 230. This step is the final step that exits the routine, and therefore, after the first rotation and second (reversing) rotations of the motor 22, the PFS counter has not yet reached 230. Accordingly, on the first two passes through step S124, control proceeds through step S124 to step S128, at which point the control routine loops until the PFS counter reaches 165. The third pass through step S124 is described below.

At 165 PFS pulses, the front sheet has been laid appropriately (to the front or rear) in the horizontal stacking support assembly 14, and the second sheet is to be directed to lay down the leading fold between the first and second sheets of the continuous form appropriately. Control passes to step S127, which checks whether the PFS pulse counter is greater than 195, indicating that the second rotation of the motor 22 has passed at least the midpoint. Since the PFS counter has not reached 195 immediately after the first rotation and verification of 165 PFS pulses at step S128, step S127 directs the control routine to step S110 at this point. That is, after the first rotation, but before the second, reversing rotation has begun, control proceeds from step S127 to step S110.

At step S110, the motor 22 is again turned ON, but in the opposite direction (via step S122) to which the motor 22 is turned ON in the first rotation. On the second (reversing) rotation, at step S114, the PFS counter (HSC) is greater than 165 (having looped at step S128), and control passes to step S116 to check if the PFS counter has reached 195. (signifying that the second rotation of two revolutions has completed one revolution, but not two revolutions).

Between the PFS count pulse values of 165 and 195, the control routine checks to see if either two "outside" folds were detected or whether no "outside" folds were detected (according to the settings of flags FU and/or FD at steps S98 and S106). Accordingly, in step S112, an exclusive OR (XOR) operation is performed on the FU and FD flags. If a zero is returned, signifying that two "outside" folds were detected or that no "outside" folds were detected (in the ranges at 33–39 PFS pulses and 99–105 PFS pulses), an error is generated and the control routine stops the motor 22 at step S113.

If only one fold, i.e., if an "outside" fold was detected at either the 33–39 PFS pulse range (FU flag) or the 99–105 PFS pulse range (FD flag), control loops between steps S114, S116, and S112 until the PFS pulse counter equals 195, at which point control passes from step S116 to step S118. That is, in the range between 165 and 195 PFS pulses, the result of the position sensor 54 is suppressed, i.e., the result is ignored by the controller 56, so that the motor 22 may make two full revolutions during the second rotation to move the rotatable guide wires 28F and 28R between the position shown in FIG. 8A to that shown in FIG. 9 (or left-right mirrored positions, depending on the orientation of the first detectable fold). That is, in the range between 165 and 196 PFS pulses, the position sensor 54 outputs a signal indicating the home position of the encoder wheel 52, i.e., indicating that each of the rotatable guide wires 28F and 28R has returned to the home position. However, since the control routine loops between steps S114, S116 and S112 in the 165–195 PFS pulse count range, no action based on the home position signal is taken by the controller 56 in the 165–195 PFS pulse count range.

However, when the controller 56 checks the PFS pulse counter at step S116 and determines that the PFS count is equal to (or greater than) 195, control proceeds to step S118. That is, toward the end of the second revolution of the second (reversed) rotation, the controller 56 again monitors the position sensor 54, and proceeds to step S120 when a full revolution of the encoder wheel 52 (corresponding to drive gear 22*b*) is detected, otherwise looping through steps S118, S114, and S116. When the controller 56 detects the home position for the first time after 195 PFS pulses, the drive gear 22*b* has turned by two revolutions from the previous stopped position (following the first rotation). Accordingly, during the second (reverse) rotation, and after 195 PFS pulses have been counted, when the encoder wheel 52 is detected at the home position (at step S118), control passes to step S120.

At step S120, the motor 22 is again turned OFF. At this point, for a first detected "outside" fold, the rotatable guide wires 28F and 28R are in the position shown in FIG. 9, as is the continuous form 74. However, if the first detected fold was an "inside" fold, then the rotatable guide wires 28F and 28R are in a position left-right mirrored with respect to the position shown in FIG. 9.

The control routine then proceeds to step S122. At step S122 the direction variable DIR is again reversed (−1 becoming 1, 1 becoming −1) to prepare for the return of the rotatable guides 28F and 28R to the home position in a third (home return) rotation. Control then passes through steps S124 (since the PFS counter HSC has not yet reached 230), S128 (since the PFS counter HSC exceeds 165), and S127 (since the PFS counter HSC exceeds 195).

At step S126, the control routine loops until the PFS counter HSC is greater than 225. At 225 PFS pulses, the leading sheet, leading fold, and the second sheet have been laid appropriately in the horizontal stacking support assembly 14. Accordingly, the front and rear rotatable wire guides 28F and 28R are to be directed to return to the home position shown in FIG. 7 such that the wire guides 28F, 28R do not interfere with subsequent stacking. Accordingly, at step S126, when the PFS counter exceeds 225, the control routine returns to step S110.

On the third (home return) rotation at step S110, the motor 22 is turned ON, now in the appropriate direction to return the rotatable guide wires 28F and 28R to their home position. The control routine again loops through steps S114, S116 and S118 until the home position is again detected at step S118, upon which the motor is turned OFF at step S120. The direction variable DIR is then reversed at step S122 (which has no further effect), and the control routine then proceeds to step S124. At step S124, after the third (home return) rotation, the PFS counter is greater than 230, (being approximately 250 after the third rotation) at which point the process ends.

When the process ends, printing may continue, and the continuous form continues to stack correctly on the horizontal stacking support assembly 14, at least the leading sheets, leading fold, and second sheet having been laid correctly on the horizontal stacking support assembly 14. The stacking may be assisted by the active stacking mechanism 76, as previously described.

FIG. 11 shows a flow chart describing a routine in which the delays and intervals are adjusted dynamically in response to changing sheet feed rates. This routine may be performed by the controller 56 concurrently with the previously described operation process. Accordingly, if the feed rate changes for any reason, e.g., if the printer 72 prints a page having a large image or graphic requiring significant processing, the delays and timing may be adjusted to compensate (e.g., by monitoring the PFS sensor 59, as shown in FIG. 11).

FIG. 12 shows a second embodiment of the leading edge directing system, in which a perforation/fold detector 57' is placed within the printer 72. In such a case, the controller 56 of the leading edge directing system may be incorporated in the controller of the printer 72. To accomplish appropriate timing and control for the second embodiment, the delays and intervals previously described are adjusted for the new distances between the perforation/fold sensor 57' and the TOF sensor 58 (e.g., being substantially the same if the perforation/fold sensor 57' is advanced by length of a sheet toward the TOF sensor 58). In addition, if the new position of the perforation/fold sensor 57 is such that the first detectable fold is now the leading fold, then the settings (1 or −1) of the direction variable DIR would be reversed from those described. Otherwise, the operation of the second embodiment is essentially similar to that described for the first embodiment.

FIGS. 13A, 13B, 14A, and 14B show a first embodiment of a fold detector 60, suitable for use as the previously described fold/perforation detector 57'. In each case, the fold detector 60 detects outside folds "O" of a form 74 having alternating inside folds "I" and outside folds "O." That is, a media stack 74*a* is conventionally folded back upon itself in accordion-fashion, and as each sheet of the form 74 is drawn from the media stack 74*a*, the successive sheets are separated by alternating inside folds "I" and outside folds "O." As previously described, an "outside" fold "O" is one that enters the printer with the fold cusp pointing upward, and an "inside" fold "I" is one that enters the printer with the fold cusp pointing downward.

Figure 13B:
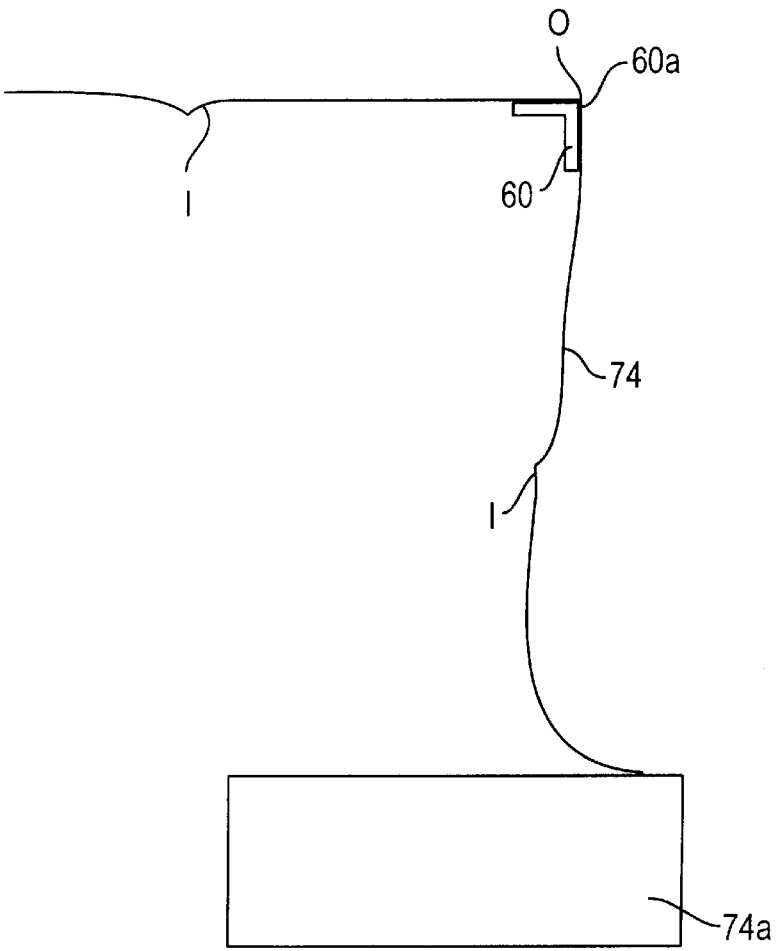
FIGS. 13A and 13B show side schematic views of a first embodiment of a fold sensor for detecting an orientation of a fold in a continuous form at two positions of the continuous form.
Figure 13A:
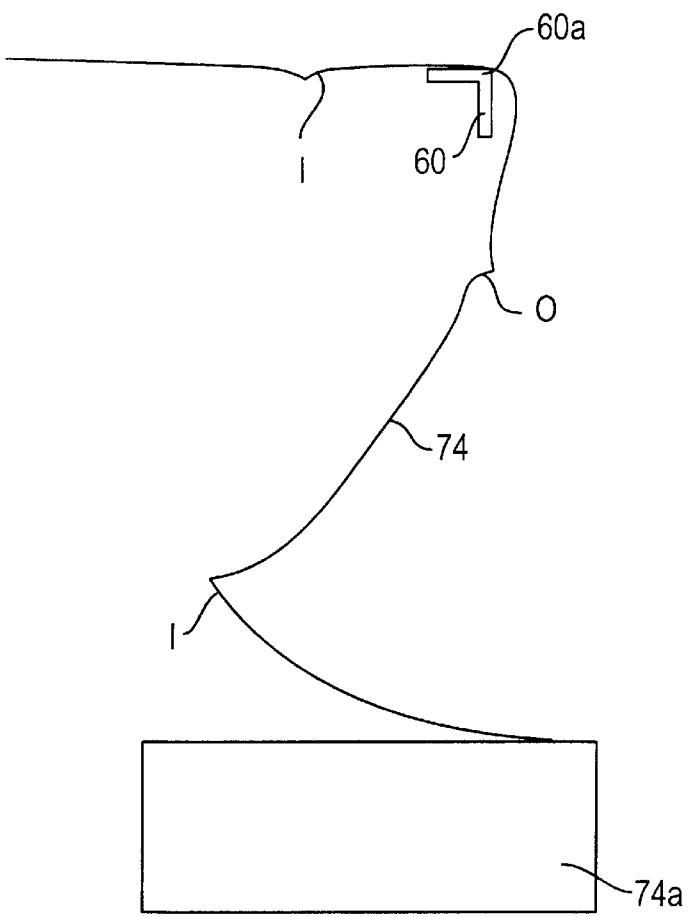

FIG. 13A shows the continuous form 74 along a transport path from the media stack 74*a* before a fold is detected, and FIG. 13B shows the continuous form 74 along the transport path as a fold (an outside fold "O") is detected. As shown in FIGS. 13A and 13B, the first embodiment of a fold detector 60 relies on observed characteristics (e.g., the fold memory and normal stiffness properties) of a pre-folded continuous form 74 as the form 74 passes over a corner 60*a*. In the context of this specification, a "corner" may be an angled, square, or rounded corner.

Upstream of the printer (not shown in FIGS. 13A, etc., but positioned downstream of the fold detector 60 along the transport path), the form 74 is only under the tension imparted to the form by the weight of the form 74 as it is drawn from the media stack 74*a*. The tension imparted by the weight of the form, i.e., gravity, is low, i.e., the weight of, at most, a few sheets of the form 74. Accordingly, although the present embodiment operates under tension imparted by the weight of one or more sheets, a tension of substantially the same or a similar amount may be imparted by known mechanical means (rollers, etc.).

As shown in FIGS. 13A and 13B, under the low tension imparted by the weight of the hanging form 74, the folds (either inside folds "I" or outside folds "O") in the form 74 do not completely straighten when drawn from the media stack 74*a*. Instead, the folds assume a typical shape as shown in FIGS. 13A and 13B, each fold forming a cusp in the form 74*a*.

As shown in FIG. 13A, when the transport path is, e.g., substantially straight for a portion downstream of the corner 60*a*, and the form 74 assumes a rounded shape passing over the corner 60*a* as it hangs down to the media stack 74*a*. The hanging portion of the form 74 is curved or rounded under cantilever action by the inherent stiffness of the form 74 and the tension (e.g., from the weight of the form 74) on the hanging portion of the form 74. That is, the corner 60*a* changes the direction of the continuous form 74, and due to the stiffness of the form 74, forms a detectable clearance between a wall of the corner 60*a* and the form 74. This rounded shape exists when either an unfolded portion of the form 74 or an inside fold "I" passes over the corner 60*a*.

However, as shown in FIG. 13B, when an outside fold "O" reaches the corner 60*a*, the form 74 moves toward, and finally contacts a wall (in FIG. 13B, a vertical wall) of the corner 60*a*. The motion and change in position and direction of the form 74 may be detected as described hereinafter. That is, since the outside fold "O" bends in the same direction as the corner 60*a*, the detectable clearance between a wall of the corner 60*a* and the form 74 is reduced.

Figure 14B:
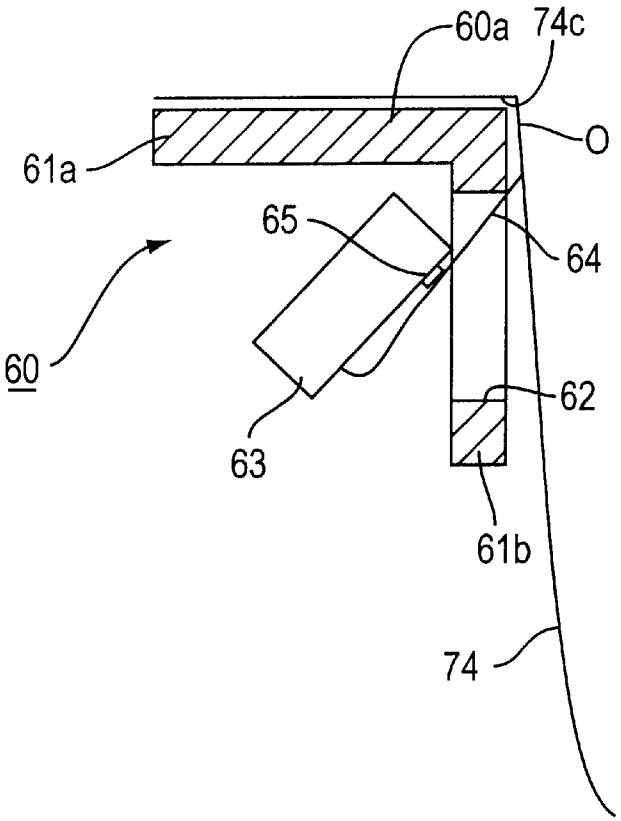
FIGS. 14A and 14B show detailed side views of the fold sensor of FIGS. 13A and 14A, respectively.
Figure 14A:
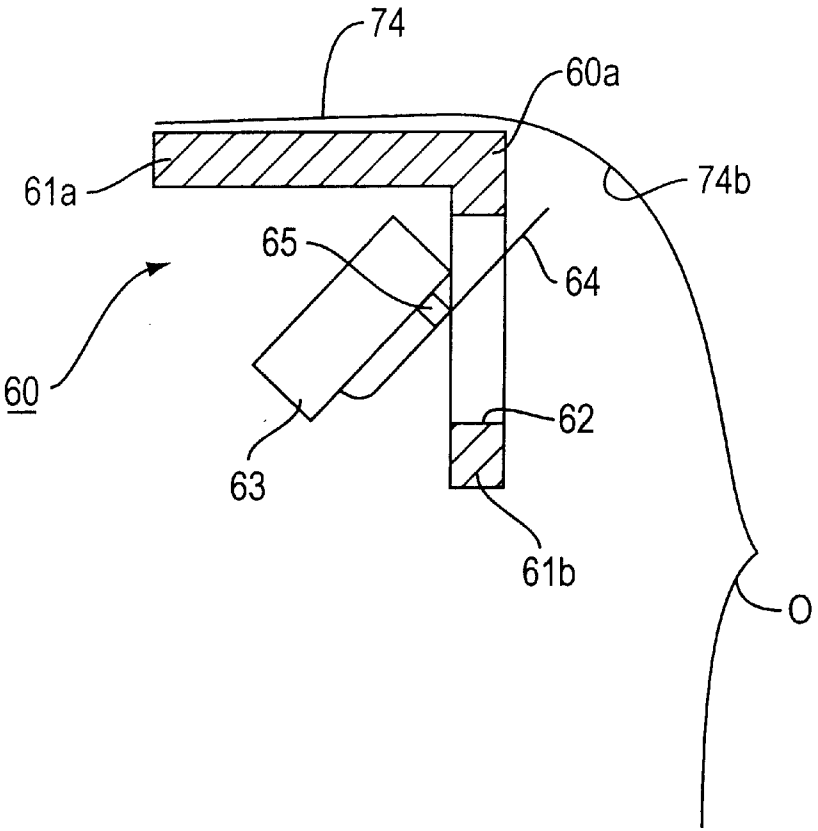

FIGS. 14A and 14B show the fold detector 60 in detail in the same conditions as FIGS. 13A and 13B, respectively. As shown in FIGS. 14A and 14B, the detector 60 includes a downstream wall 61*a* (e.g., a horizontal wall) and a detection wall 61*b* (e.g., a vertical wall) that intersect to form an angled corner 60*a*, with an opening 62 formed in the detection wall 61*b*. A media detection switch 63 (in this case, a limit switch) faces the detection wall 61*b*. The media detection switch 63 includes a plunger 65, and a resilient lever 64 of the media detection switch 63 protrudes through the opening 62. Although the detection wall 61*b* is shown as vertical and at a right angle to the downstream wall 61*a* in this embodiment, the detection wall 61*b* may be inclined to the downstream wall 61*a*, although it is necessary that a sufficiently large detection clearance may be formed between a hanging arc 74*b* and the detection wall 61*b* as described below.

As shown in FIG. 14A, when the transport path is, e.g., substantially straight downstream of the corner 60*a* along the downstream wall 61*a*, and an unfolded portion of the form 74 (or an inside fold "I") passes over the corner 60*a*, the form 74 assumes a rounded shape passing over the corner 60*a*. A hanging arc 74*b* of the form is rounded under cantilever action by the inherent stiffness of the form 74 and the tension (e.g., from the weight of the form 74) on the hanging portion of the form 74. A gap is formed between the hanging arc 74*b* and the detection wall 61*b*. That is, the corner 60*a* changes the direction of the continuous form 74, and due to the stiffness of the form 74, forms a detectable clearance between the detection wall 61*b* of the angled corner 60*a* and the form 74. The resilient lever 64 of the media detection switch 63 extends into the detectable clearance, but the form 74 does not contact the resilient lever 64. That is, the media detection switch 63 is responsive to the detectable clearance, and more particularly, is responsive to the reduction of the detectable clearance.

However, as shown in FIG. 14B, when an outside fold "O" reaches the corner 60*a*, since the outside fold "O" bends in the same direction as the corner 60*a*, the detectable clearance between the detection wall 61*b* and the form 74 is reduced as the form 74 moves toward the detection wall 61*b*. The form 74 contacts the resilient lever 64 of the media detection switch 63, and moves the resilient lever 64 of the limit switch such that the plunger 65 of the media detection switch 63 is depressed. Accordingly, the reduction of the detectable clearance by the corner 60*a* activates the media detection switch 63 and thereby signals the detection of a fold (an outside fold "O"). Subsequently, as the outside fold "O" passes over the corner 60*a*, the form 74 again develops the rounded shape shown in FIG. 14A, and the resilient lever 64 is released as it resiliently returns to the position shown in FIG. 14A (extending into the gap under the hanging arc 74*b*). In this manner, the fold detector 60 may detect all successive outside folds "O" passing over the detector 60.

The media detection switch 63 may be, but is not limited to, an optoelectronic interrupt switch, a snap action switch, a reflective object switch, a pneumatic proximity sensor, or an optoelectronic proximity sensor. The switch 63 may be of ON-OFF type, of graduated output, or waveform-generating. The (signal waveform-generating) switch 68 of the second embodiment of a fold-detector 60' (described below) may be used in place of the (ON-OFF) limit switch 63 in the first embodiment of a fold detector 60.

FIGS. 15A, 15B, 16A, 16B, 17A, and 17B show a second embodiment of a fold detector 60', suitable for use as the previously described fold/perforation detector 57'. In each case, the fold detector 60' detects at least outside folds "O" of a form 74 having alternating inside folds "I" and outside folds "O."

Figure 15B:
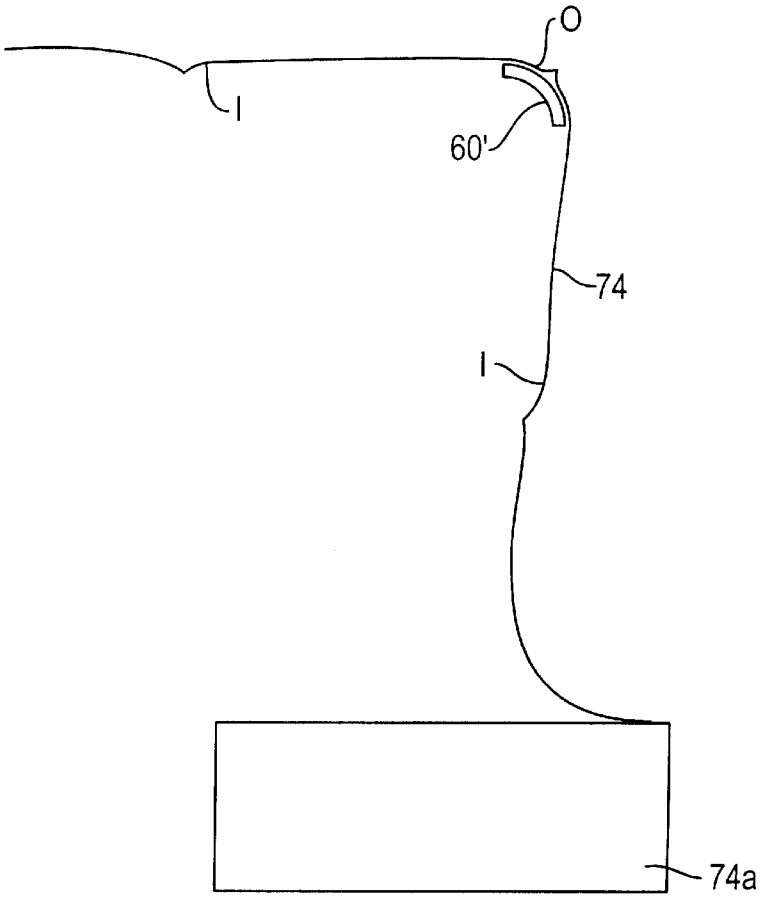
FIGS. 15A and 15B show side schematic views of a second embodiment of a fold sensor for detecting an orientation of a fold in a continuous form at two positions of the continuous form.
Figure 15A:
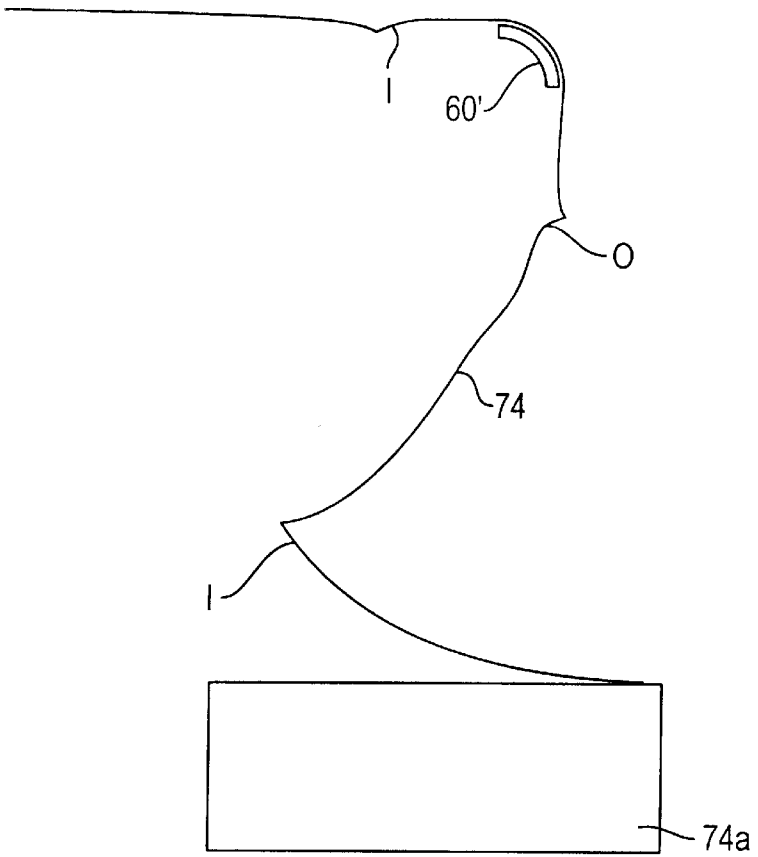

FIG. 15A shows the continuous form 74 along a transport path from the media stack 74*a* before a fold is detected, and FIG. 15B shows the continuous form 74 along the transport path as a fold (an outside fold "O") is detected. As shown in FIGS. 15A and 15B, the second embodiment of a fold detector 60 relies on observed characteristics (e.g., the fold memory and normal stiffness properties) of a prefolded continuous form 74 as the form 74 passes over an arcuate corner 66 (e.g., a curved guide).

As shown in FIGS. 15A and 15B, the form 74 is only under the tension imparted to the form by the weight of the form 74 as it is drawn from the media stack 74*a*, similarly to that previously described with respect to FIGS. 13A through 14B. Again, under the low tension imparted by the weight of the hanging form 74, the folds in the form 74 do not completely straighten when lifted from the media stack 74*a*, each fold forming a cusp as shown in FIGS. 15A and 15B. That is, the arcuate corner 66 changes the direction of the continuous form 74, and due to the stiffness of the inside or outside fold "I" or "O", forms a detectable clearance between the wall of the arcuate corner 66 and the form 74.

As shown in FIG. 15A, when the transport path is, e.g., substantially straight downstream of the arcuate corner 66, and the form 74 hangs down to the media stack 74*a*, the form 74 assumes an overall rounded shape along the arcuate corner 66. This overall rounded shape exists when an unfolded portion of the form 74, an inside fold "I," or an outside fold "O" passes along the arcuate corner 66.

However, as shown in FIG. 15B, when an outside fold "O" reaches the arcuate corner 66, the overall rounded shape is interrupted by the cusp of the fold "O" remaining in the form 74, the cusp pointing away from the arcuate corner 66. That is, the arcuate corner 66 changes the direction of the continuous form 74, and due to the stiffness of the outside fold "O" in the form 74, forms a detectable clearance between the arctuate corner 66 and the outside fold "O" in the form 74. The detectable clearance may be detected as described hereinafter.

Figure 16B:
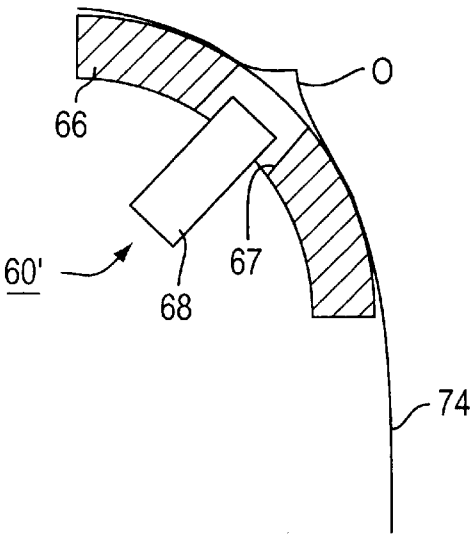
FIGS. 16A and 16B show detailed side views of the fold sensor of FIGS. 15A and 15A, respectively.
Figure 16A:
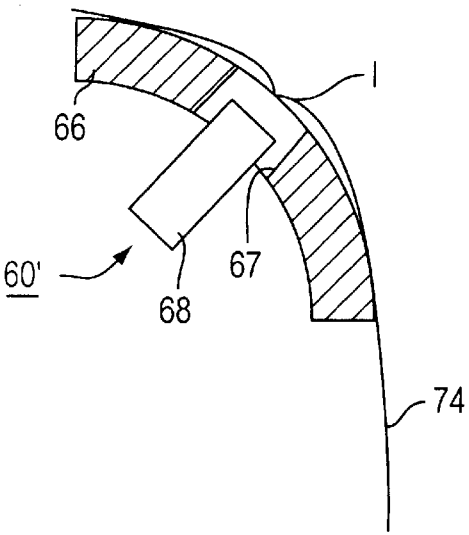

FIGS. 16A shows the fold detector 60' in detail when an inside fold "I" passes over the fold detector 60', and FIG. 16B shows the fold detector 60' in detail in the same condition as FIG. 15B, i.e., when an outside fold "O" passes over the fold detector 60'. As shown in FIGS. 16A and 16B, the detector 60' includes an arcuate corner 66 (e.g., curving from a horizontal direction to a vertical direction), with an opening 67 formed in the arcuate corner 66. A media detection (proximity) switch 68 faces the opening 67 formed in the arcuate corner 66. That is, the media detection (proximity) switch 68 is responsive to the detectable clearance, and more particularly, is responsive to the formation of the detectable clearance.

Figure 17B:
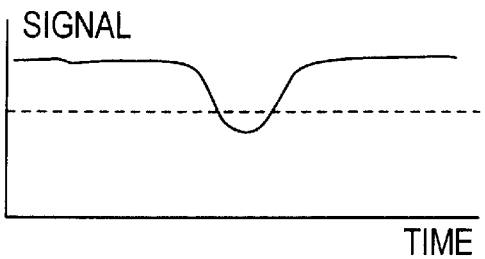
FIGS. 17A and 17B show signals generated by the fold sensor of FIGS. 16A and 16B, respectively.
Figure 17A:
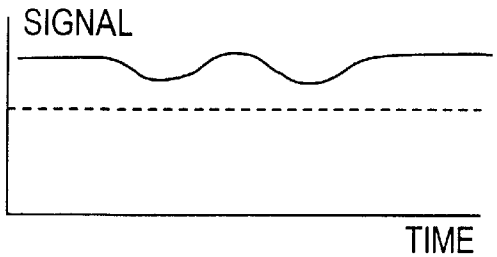

As shown in FIG. 16A, when an inside fold "I" of the form 74 passes over the arcuate corner 66, the form 74 assumes a generally rounded shape passing over the arcuate corner 66, with the cusp of the inside fold "I" pointing toward the arcuate corner 66 and toward the media detection (proximity) switch 68. FIG. 17A shows a signal generated by the media detection switch 68 as the inside fold "I" passes. In this respect, since the curves of the cusp of the inside fold "I" curve toward the arcuate corner 66 and the media detection (proximity) switch 68, as shown in FIG. 16A, the media detection (proximity) switch 68 senses, e.g., two local minima and a maxima therebetween, as shown in FIG. 17A. If a threshold level (peak-to-peak or otherwise) is set for detection of a fold (e.g., as shown by the dashed line in FIG. 17A), the signal generated by an inside fold "I" will lie above the threshold, and be treated the same as no fold. That is, the arcuate corner 66 changes the direction of the continuous form 74 in the same direction as the curves as the cusp of the inside fold "I", the clearance between the arcuate corner 66 and the inside fold "I" in the form 74 is minimally change.

The threshold level may be set, e.g., in the media detection (proximity) switch 68 itself or in a controller attached thereto (not shown in FIGS. 16A and 16B, but preferably a configuration such as that shown in FIG. 5 with respect to controller 56 and perforation/fold detector 57). If a threshold level is set in this manner, the media detection (proximity) switch 68 is not activated by an inside fold "I." Alternatively, the signal may be recognized as that of an inside fold "I" by the distribution of maxima and minimum.

As shown in FIG. 16B, when an outside fold "O" of the form 74 passes over arcuate corner 66, the form 74 assumes a generally rounded shape passing over the arcuate corner 66, with the cusp of the outside fold "O" pointing away from the arcuate corner 66 and away from the media detection (proximity) switch 68. FIG. 17B shows a signal generated by the media detection (proximity) switch 68 as the outside fold "O" passes switch 68. In this respect, since the curves of the cusp of the outside fold "O" curve away from the arcuate corner 66 and the media detection (proximity) switch 68, as shown in FIG. 16B, a signal generated by the media detection (proximity) switch 68 has a minimum, as shown in FIG. 17B. If a threshold level (peak-to-peak or otherwise) is set for detection of a fold (e.g., as shown by the dashed line in FIG. 17B), the signal generated by an outside fold "O" falls below the threshold, and is detected as a fold. That is, the media detection (proximity) switch 68 is responsive to the formation of the detectable clearance of the outside fold "O" of the form 74. Alternatively, the signal may be recognized as that of an outside fold "O" by the distribution of minimum and flat portions of the curve.

Subsequently, as the outside fold "o" is transported past the media detection switch 68 along the arcuate corner 66, the form 74 again follows the arcuate corner 66 as shown in FIG. 15A, and the signal level of the media detection (proximity) switch 68 is raised to a baseline or zeroed value along with the detectable clearance. In this manner, the fold detector 60' may detect all successive outside folds "O" passing over the detector 60', or both inside and outside folds "I" and "O" passing over the detector 60'.

The media detection (proximity) switch 68 may be, but is not limited to, an optoelectronic interrupt switch, a snap action switch, a reflective object switch, a pneumatic proximity sensor, or an optoelectronic proximity sensor. The switch 68 may be of ON-OFF type, of graduated output, or waveform-generating. The (ON-OFF) switch 63 of the first embodiment of a fold-detector 60 may be used in place of the waveform-generating switch 68 in the second embodiment of a fold detector 60'.

It should be noted that although each of the first and second embodiments of a fold detector 60 and 60' uses a minimal tension in the form 74 imparted by the weight of the form, it is not necessary that the form 74 hang down to the media stack 74*a*. For example, in both cases, the minimal tension may be generated by rollers, sprockets, or other feeding device, or by bends or a labyrinth in the continuous form 74 transport or guide path. Accordingly, the media stack 74*a* need not be below the detector 60 or 60', but may be at the same height or higher.

Furthermore, although each detector 60 and 60' is shown as positioned at a junction between a horizontal portion of the form 74 transport path and a vertical portion of the form 74 transport path (e.g., where the form 74 hangs down toward the media stack 74*a*), either of the detectors 60 or 60' may be positioned in the middle of a horizontal, vertical, or inclined portion of the form 74 transport path, if the profile achieves the characteristics noted above. That is, it is required that the detector 60 or 60' changes the direction of the form 74, at least temporarily.

For example, the first embodiment of a fold detector 60 requires a sufficiently long downstream portion (e.g. horizontal wall 61*a*), coupled with a detection wall 61*b* sufficiently angled from the downstream portion, to form a corner 61 that generates the described gap when a form 74 extends across the two walls 61*a* and 61*b* of the corner 61. However, either of the walls 61*a* or 61*b* may be horizontal, inclined, or vertical, and the corner 61 may be placed in the middle of, or at a junction of, horizontal, inclined, or vertical portions of the transport path of the form 74. Similarly, the second embodiment of a fold detector 60' merely requires that a sufficient length of the form 74 follow an arcuate corner 66; the arcuate corner 66 need not be of any particular radius, sector amount, or orientation, and may be placed in the middle of, or at a junction of, horizontal, inclined, or vertical portions of the transport path of the form 74.

Furthermore, although placing the fold detector 60 or 60' upstream of the printer is advantageous (i.e., at the inlet of the printer) because the folds have not yet been "ironed out" by a fusing unit of the printer, the fold detector 60 or 60' may be positioned within the printer (e.g., as shown with respect to sensor 57' in FIG. 12) or downstream of the printer (i.e., at the outlet of the printer).

As described, the leading edge directing system, including the various sensors and inputs to the controller 56, can conduct operations in which: (1) the position(s) of the first and/or subsequent fold(s) and/or leading edge are detected; (2) the orientation(s) of the first and/or subsequent fold(s) are detected; (3) the position(s) of first and/or subsequent fold(s) and/or leading edge are set manually by an operator; (4) the position(s) of the first and/or subsequent fold(s) and/or leading edge are determined according to a timer from a predetermined position; (5) the position(s) of the first and/or subsequent fold(s) and/or leading edge are determined according to direct measurement of the advance of the continuous form and/or the feeding device; and/or (6) the continuous form is set in a predetermined position and the leading edge directing system is started, including any combinations of these operations.

Various modifications may be made to the system without departing from the spirit and scope of the invention.

For example, the control system may be arranged to proceed from the position of FIG. 7 to one of FIGS. 8A or 9, and then to return to FIG. 7, therefore laying the first sheet only in the appropriate direction. In such a case, the leading fold and second sheet would be allowed to fall into position without assistance from the leading edge directing system.

As described, the leading edge directing system according to the invention appropriately directs leading sheets of a pre-folded continuous form so that all subsequent folding onto a stack develops correctly. Furthermore, the leading edge. directing system appropriately directs leading sheets of a continuous form for any orientation of the folds in the pre-folded continuous form. Since only one guide wire is permitted to contact the form at any time, timing for detection locations/intervals for controlling the laying of the first and/or subsequent sheet(s) may be arranged according to relaxed ranges (rather than exact values) and the system may therefore handle various types of forms having various characteristics.

Although the above description sets forth particular embodiments of the present invention, modifications of the invention will be readily apparent to those skilled in the art, and it is intended that the scope of the invention be determined by the appended claims.

What is claimed is:

1. A fold detector that detects folds in a pre-folded continuous form moving along a transport path, comprising:

at least one wall placed along the transport path, said at least one wall forming a corner that changes a direction of the continuous form and forms a detectable clearance, depending on predetermined stiffnesses of the continuous form and the folds, between said at least one wall and the continuous form, an opening being formed through said at least one wall at the corner, and wherein said at least one wall comprises two substantially straight walls that intersect to form an angled corner, said angled corner changing a direction of the continuous form so that said detectable clearance forms between one of said substantially straight walls and the continuous form when no detectable fold is at said angled corner and said detectable clearance reduces when a detectable fold is at said angled corner;

a media detection sensor that senses said continuous form at said opening, said media detection sensor being responsive to the detectable clearance to sense the folds in the continuous form, said media detection sensor being responsive to said reducing of said detectable clearance to sense the folds in the continuous form, and wherein said media detection sensor comprises a limit switch having a movable lever emerging from said opening at said one of said substantially straight walls, so that said movable lever is depressed and said limit switch activated when said detectable clearance is reduced and said movable lever is released and said limit switch deactivated when said detectable clearance is formed.

2. The fold detector according to claim 1, wherein said two substantially straight walls intersect at a right angle to form a right angled corner, and said one of said substantially straight walls being vertical and a remaining one of said substantially straight walls being horizontal.

3. The fold detector according to claim 1, wherein said at least one wall comprises an arcuate wall that forms an arcuate corner, said arcuate corner changing a direction of the continuous form so that said detectable clearance forms between said arcuate corner and said continuous form when a detectable fold is at said arcuate corner and said detectable clearance is reduced when no detectable fold is at said arcuate corner, said media detection sensor being responsive to said forming of said detectable clearance to sense the folds in the continuous form.

4. The fold detector according to claim 3, wherein said arcuate wall curves from a horizontal direction to a vertical direction.

5. The fold detector according to claim 1, wherein said media detection sensor comprises a proximity switch directed through said opening, so that said proximity switch is deactivated when said detectable clearance is formed and said proximity switch is activated when said detectable clearance is reduced.

* * * * *